US010053324B2

(12) United States Patent
Abe

(10) Patent No.: US 10,053,324 B2
(45) Date of Patent: Aug. 21, 2018

(54) SHEET PROCESSING APPARATUS AND IMAGE FORMING APPARATUS WITH SHEET BINDING USING CONCAVITIES AND CONVEXITIES

(71) Applicant: CANON KABUSHIKI KAISHA, Tokyo (JP)

(72) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/729,587

(22) Filed: Jun. 3, 2015

(65) Prior Publication Data

US 2015/0353316 A1 Dec. 10, 2015

(30) Foreign Application Priority Data

Jun. 4, 2014 (JP) ..... 2014-115529
May 19, 2015 (JP) ..... 2015-101950

(51) Int. Cl.
*B65H 37/04* (2006.01)
*B65H 39/00* (2006.01)
(Continued)

(52) U.S. Cl.
CPC ..... *B65H 37/04* (2013.01); *B65H 31/26* (2013.01); *B65H 39/00* (2013.01); *G03G 15/6544* (2013.01); *G03G 2215/00848* (2013.01)

(58) Field of Classification Search
CPC . B65H 37/04; G03G 15/6544; H04N 1/00639
(Continued)

(56) References Cited

U.S. PATENT DOCUMENTS 8,177,214 B2 * 5/2012 Sato ..... B42B 4/00 270/52.18
8,342,497 B2 1/2013 Abe
(Continued)

FOREIGN PATENT DOCUMENTS

CN 103359532 A 10/2013
CN 104340744 A 2/2015
(Continued)

OTHER PUBLICATIONS

Search Report dated Oct. 7, 2015, in European Application No. 15170192.7.
(Continued)

*Primary Examiner* — Patrick H Mackey
(74) *Attorney, Agent, or Firm* — Fitzpatrick, Cella, Harper & Scinto

(57) ABSTRACT

A sheet processing apparatus includes a first member having a first concavo-convex portion in which pluralities of concavities and convexities are provided, a second member having a second concavo-convex portion in which pluralities of concavities and convexities are provided and clamping a sheet bundle together with the first concavo-convex portion of the first member, and a supporting portion supporting at least one of the first and second members turnably centering on a turning center. The first concavo-convex portion is configured such that a distance between an end on the turning center side of one convex portion among the pluralities of concavities and convexities and the turning center is different from a distance between an end on the turning center side of another convex portion and the turning center.

16 Claims, 15 Drawing Sheets

(51) Int. Cl.
*B65H 31/26* (2006.01)
*G03G 15/00* (2006.01)

(58) Field of Classification Search
USPC ..... 270/58.08
See application file for complete search history.

(56) References Cited

U.S. PATENT DOCUMENTS

| | | | | |
|---|---|---|---|---|
| 8,899,568 | B2 * | 12/2014 | Matsushita | B31F 5/02 270/58.07 |
| 9,126,794 | B2 * | 9/2015 | Abe | G03G 15/6541 |
| 9,254,621 | B2 | 2/2016 | Takahashi et al. | |
| 2010/0301541 | A1 | 12/2010 | Sato | |
| 2012/0090441 | A1 | 4/2012 | Abe | |
| 2013/0214470 | A1 * | 8/2013 | Yokomizo | B65H 37/04 270/1.01 |
| 2013/0264762 | A1 * | 10/2013 | Matsushita | B31F 5/02 270/58.08 |
| 2014/0003852 | A1 * | 1/2014 | Abe | G03G 15/6541 399/408 |
| 2014/0077437 | A1 | 3/2014 | Abe et al. | |
| 2014/0161565 | A1 | 6/2014 | Obuchi et al. | |
| 2015/0003938 | A1 * | 1/2015 | Morinaga | B42C 13/00 412/11 |
| 2015/0003939 | A1 | 1/2015 | Abe | |
| 2015/0239587 | A1 | 8/2015 | Abe | |
| 2015/0266694 | A1 | 9/2015 | Abe et al. | |
| 2016/0107409 | A1 * | 4/2016 | Kubo | B31F 1/07 412/33 |

FOREIGN PATENT DOCUMENTS

| | | | |
|---|---|---|---|
| EP | 2713214 | A2 | 4/2014 |
| EP | 2829410 | A1 | 1/2015 |
| JP | 2011-201653 | A | 10/2011 |
| MX | PA02011504 | A * | 5/2004 |

OTHER PUBLICATIONS

U.S. Appl. No. 14/790,129, filed Jul. 2, 2015.
Office Action dated Aug. 29, 2016, in Chinese Patent Application No. 201510301140.7.
English Translation of MX PA02011504 A (original document published May 26, 2004).
Office Action dated Dec. 25, 2017, in Chinese Patent Application No. 201510301140.7.
Office Action dated Jun. 8, 2018, in European Patent Application No. 15170192.7.

* cited by examiner

SHEET PROCESSING APPARATUS AND IMAGE FORMING APPARATUS WITH SHEET BINDING USING CONCAVITIES AND CONVEXITIES

BACKGROUND OF THE INVENTION

Field of the Invention

The present invention relates to a sheet processing apparatus processing a sheet and to an image forming apparatus.

Description of the Related Art

Hitherto, there is an image forming apparatus, such as a copier, a laser beam printer, a facsimile, and a multi-function printer, including a sheet processing apparatus performing a binding process or the like to a sheet on which an image has been formed. In a case of binding a sheet bundle by the sheet processing apparatus, such image forming apparatus is configured to bind the sheet bundle by using a metallic staple in general. The stapling process using such staple is adopted in many sheet processing apparatuses because it enables to steadily bind a plurality of output sheets at a position specified by a user.

However, although it is possible to steadily bind the sheet bundle by the stapling process using the metallic staple, it is necessary to use a dedicated tool in order to release the bundle once bound by the staple. It is also necessary to remove the staple in shredding the stapled sheet or in recycling the stapled sheet bundle. That is, the sheet and the staple must be separately collected.

Therefore, among the conventional sheet processing apparatuses, there is proposed one that places an importance on recyclability and is configured to bind a sheet without using a staple. As such sheet processing apparatus, there is one performing a binding process on a sheet bundle by a binding portion having convex upper teeth and concave lower teeth as disclosed in Japanese Patent Application Laid-open No. 2011-201653 for example.

After bundling and aligning sheets, the sheet processing apparatus binds the sheet bundle by entangling fibers of the overlapping sheets of the sheet bundle by engaging the lower and upper teeth of the binding portion to form concavities and convexities in a thickness direction at a part of the sheet bundle. That is, this sheet processing apparatus binds the fibrous sheets without using a staple. It is noted that the way of binding the bundle of the fibrous sheets without using the staple will be referred to as a stapleless binding method' hereinafter.

The conventional sheet processing apparatus includes the lower teeth mounted to one end portion of a fixed lower arm and the upper teeth mounted to one end portion of an upper arm supported swingably in a vertical direction and binds the sheet bundle by engaging the lower teeth with the upper teeth by swinging the upper arm. Here, the lower and upper teeth are disposed such that a teeth arrangement direction is in parallel with a turning shaft of the upper arm. A binding direction on the sheet bundle also runs in parallel with or vertically to an edge side of the sheet bundle.

By the way, in the case when the teeth arrangement direction of the lower and upper teeth are disposed in parallel with the turning shaft of the upper arm, all teeth of the lower and upper teeth abut against the sheets simultaneously in clamping the sheets when the upper arm is swung because distances between the lower and upper teeth changes uniformly. In this case, a total load F required to bind by the lower and upper teeth is $n \times f$, where f is a load required for a set of teeth of the lower and upper teeth to bind the sheets and n is a number of teeth of the lower and upper teeth.

Here, because strength and size of each component of the binding portion are determined by the total load F, the greater the total load F, the more the required strength increases, the more the device is enlarged, and along with that, the more the cost of the device increases. Meanwhile, because a greater number of teeth increases a fastening force of the sheet bundle, the number of teeth of the lower and upper teeth may be increased to enhance the fastening force of the sheet bundle. However, if the number of teeth is increased, the total load required for binding the sheet bundle increases. Thus, the cost increases if one tries to enhance the force fastening the sheet bundle, and if one tries to cut the cost, the sheet bundle cannot be bound by strong fastening force.

SUMMARY OF THE INVENTION

According to a first aspect of invention, a sheet processing apparatus includes a first member having a first concavo-convex portion in which pluralities of concavities and convexities are provided, a second member having a second concavo-convex portion in which pluralities of concavities and convexities are provided, the second concavo-convex portion clamping and binding a sheet bundle together with the first concavo-convex portion of the first member, and a supporting portion supporting at least one of the first and second members turnably centering on a turning center. The first concavo-convex portion is configured such that a distance between an end on the turning center side of one convex portion of the pluralities of concavities and convexities and the turning center is different from a distance between an end on the turning center side of another convex portion and the turning center.

According to a second aspect of the invention, a sheet processing apparatus includes a first member, a second member clamping a sheet together with the first member, a binding portion provided in the first and second members and binding a sheet bundle by deforming the sheet bundle in a sheet thickness direction, and a supporting portion supporting at least one of the first and second members turnably centering on a turning center. The binding portion gradually deforms the sheet bundle in an axial direction of the turning center in deforming the sheet bundle.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
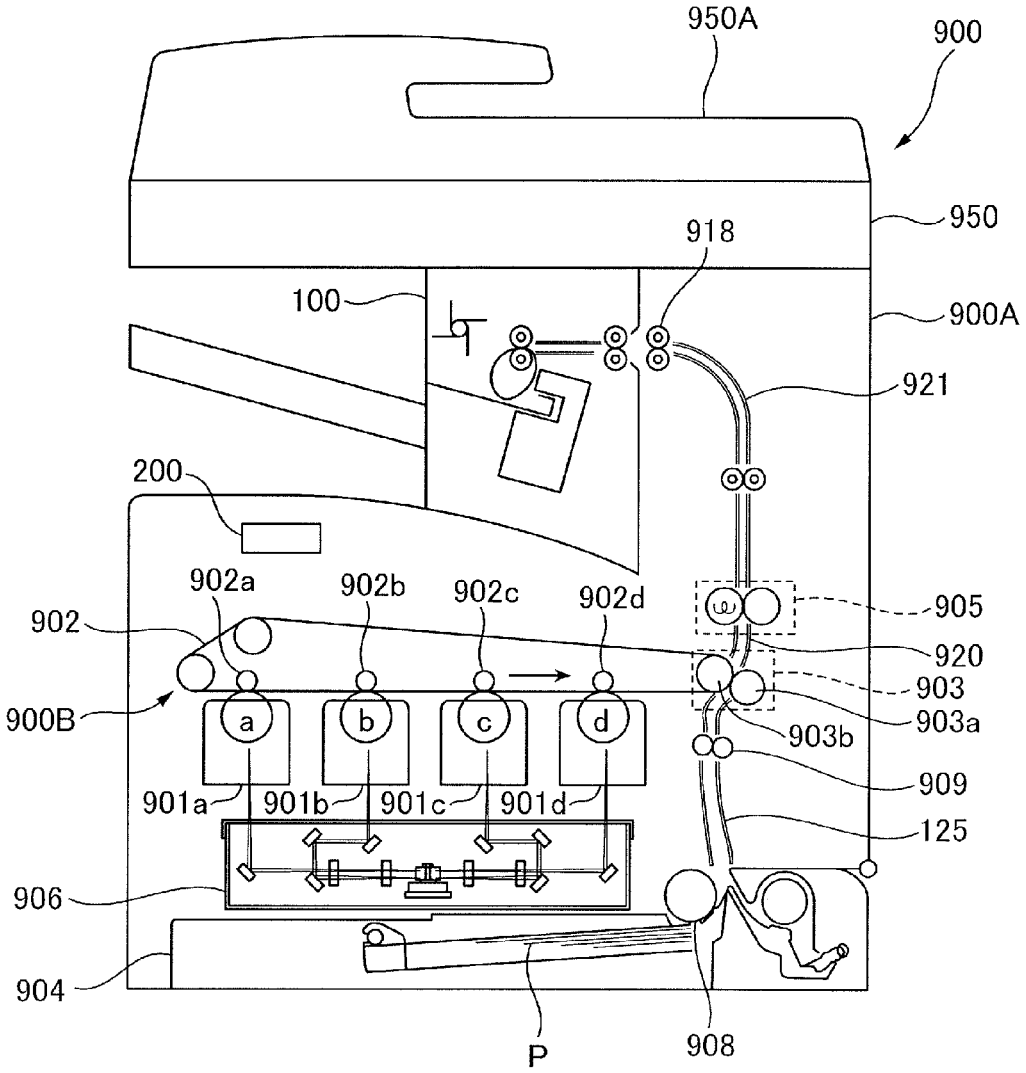
FIG. 1 is a schematic diagram illustrating a configuration of an image forming apparatus including a sheet processing apparatus of an embodiment of the invention.

Modes for carrying out the invention will be described in detail below with reference to the drawings. FIG. 1 is a schematic diagram illustrating a configuration of an image forming apparatus including a sheet processing apparatus of an embodiment of the invention. As shown in FIG. 1, the image forming apparatus 900 includes an image forming apparatus body (referred to simply as an 'apparatus body' hereinafter) 900A, an image forming portion 900B forming an image on a sheet, an image reading apparatus 950 provided at upper part of the apparatus body 900A and including a document feeder 950A, and a finisher 100, i.e., a sheet processing apparatus, disposed between an upper surface of the apparatus body 900A and the image reading apparatus 950.

Here, the image forming portion 900B includes photosensitive drums a through d forming four color toner images of yellow, magenta, cyan, and black and an exposure apparatus 906 forming electrostatic latent images on the photosensitive drums by irradiating laser beams based on image information. It is noted that these photosensitive drums a through d are driven by a motor not shown, and primary chargers, developers, transfer chargers, and others not shown are disposed around the photosensitive drums. These are unitized as process cartridges 901*a* through 901*d*.

The image forming portion 900B also includes an intermediate transfer belt 902 rotationally driven in a direction of an arrow, a secondary transfer portion 903 transferring a full-color image formed on the intermediate transfer belt 902 sequentially on the sheet P, and others. The full-color image is formed on the intermediate transfer belt 902 by sequentially superimposing and transferring the respective color toner images on the photosensitive drums to the intermediate transfer belt 902 by applying transfer bias to the intermediate transfer belt 902 by the transfer chargers 902*a* through 902*d*.

The secondary transfer portion 903 is composed of a secondary transfer counter roller 903*b* supporting the intermediate transfer belt 902 and a secondary transfer roller 903*a* abutting with the secondary transfer counter roller 903*b* through an intermediary of the intermediate transfer belt 902. It is noted that as shown in FIG. 1, the image forming apparatus 900 also includes a registration roller 909, a sheet feed cassette 904, a pickup roller 908 feeding the sheet P stored in the sheet feed cassette 904, a CPU circuit portion 200, i.e., a control portion, controlling the apparatus body 900A and the finisher 100.

Next, an image forming operation of the image forming apparatus 900 constructed as described above will be described. When the image forming operation starts, the exposure unit 906 irradiates laser beams based on the image information from a personal computer or the like not shown and sequentially exposes the photosensitive drums a through d whose surfaces are homogeneously electrified with predetermined polarity and potential to form electrostatic latent images thereon. Subsequently, the electrostatic latent images are developed and visualized by toner.

For instance, the exposure unit 906 irradiates a laser beam of an image signal of a yellow component color of a document to the photosensitive drum a through a polygonal mirror and others thereof to form a yellow electrostatic latent image on the photosensitive drum a. Then, this yellow electrostatic latent image is developed by yellow toner supplied from the developer and is visualized as a yellow toner image. After that, the toner image is brought to the primary transfer portion where the photosensitive drum a abuts with the intermediate transfer belt 902 as the photosensitive drum a rotates. Here, when the toner image comes thus to the primary transfer portion, the yellow toner image on the photosensitive drum a is transferred to the intermediate transfer belt 902 by the primary transfer bias applied to the transfer charger 902*a* (primary transfer).

Next, when a region of the intermediate transfer belt 902 carrying the yellow toner image moves, a magenta toner image formed until then on the photosensitive drum b in the same manner as described above is transferred to the intermediate transfer belt 902 while being superimposed on the yellow toner image. As the intermediate transfer belt 902 moves, cyan and black toner images are transferred while being superimposed on the yellow and magenta toner images respectively in the primary transfer portions. Thus, the full-color toner image is formed on the intermediate transfer belt 902.

Still further, in parallel with the toner image forming operation, the sheet P stored in the sheet feed cassette 904 is delivered one by one by the pickup roller 908. Then, the sheet P reaches the registration roller 909 and is conveyed to the secondary transfer portion 903 after adjustment of timing made by the registration roller 909. Subsequently, the four color toner images on the intermediate transfer belt 902 are collectively transferred onto the sheet P in the secondary transfer portion 903 by a secondary transfer bias applied to the secondary transfer roller 903*a*, i.e., a transfer portion (secondary transfer).

Next, the sheet P on which the toner image has been transferred is conveyed from the secondary transfer portion 903 to the fixing portion 905 while being guided by the conveyance guide 920, and the toner image is fixed to the sheet P by receiving heat and pressure while passing through the fixing portion 905. After that, the sheet P on which the image has been thus fixed is conveyed to the finisher 100 after passing through a discharging path 921 provided downstream of the fixing portion 905 and discharged by a discharging roller 918.

Figure 2A:
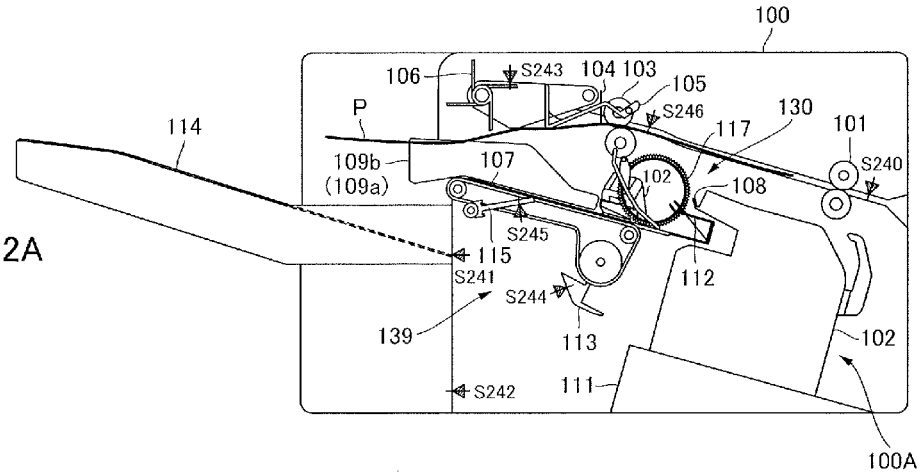
FIG. 2A is a schematic diagram illustrating a finisher in a state in which a sheet is discharged to an intermediate processing tray.
Figure 2B:
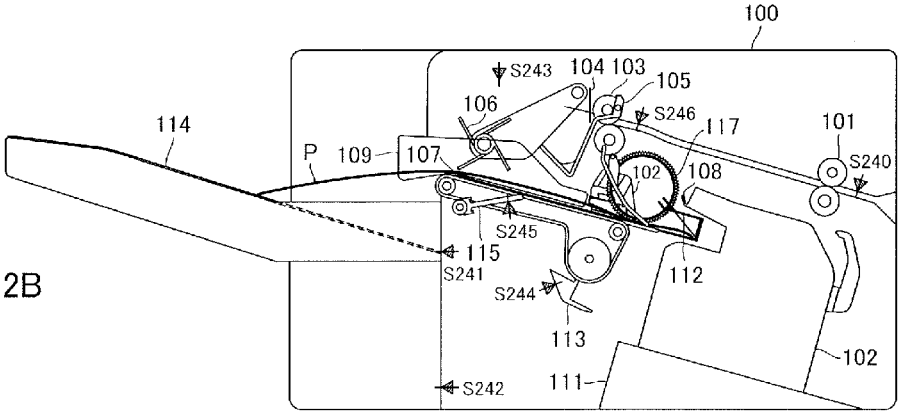
FIG. 2B is a schematic diagram illustrating the finisher in a state in which the sheet has been discharged to the intermediate processing tray.

Here, the finisher 100 performs processes of sequentially taking in the sheets discharged out of the apparatus body 900A, of aligning the plurality of taken-in sheets to bundle as one bundle, and of binding an upstream end in a sheet discharge direction (referred to as a 'rear end' hereinafter) of the bundled sheet bundle (binding process). As shown in FIGS. 2A and 2B, the finisher 100 includes a processing portion 139 performing the binding process as necessary and discharging and stacking the sheet bundle to a stacking tray 114. It is noted that the processing portion 139 includes an intermediate processing tray 107, i.e., a sheet stacking portion, stacking the sheets on which the binding process is to be performed and a binding device 100A binding the sheets stacked on the intermediate processing tray 107.

The intermediate processing tray 107 is also provided with front and rear aligning plates 109*a* and 109*b* regulating (aligning) both side end positions in a width direction (depth direction) of the sheet conveyed from a direction orthogonal to the depth direction of the apparatus body 900A. It is noted that the front and rear aligning plates 109*a* and 109*b*, i.e., side end aligning portion, aligning the widthwise side end positions of the sheet stacked on the intermediate processing tray 107 move widthwise by being driven by an alignment motor M253 shown in FIG. 6 and described later.

Normally, the front and rear aligning plates 109*a* and 109*b* are moved to a receiving position for receiving the sheet by the alignment motor M253 driven based on a detection signal of an alignment HP sensor not shown. Then, the alignment motor M253 is driven and the front and rear aligning plates 109*a* and 109*b* are moved widthwise to abut with both side ends of the sheet stacked on the intermediate processing tray 107 in regulating both side end positions of the sheet stacked on the intermediate processing tray 107.

Still further, a draw-in paddle 106 is disposed above a downstream side in the sheet conveying direction of the intermediate processing tray 107. Here, before a sheet is conveyed to the processing portion 139, the draw-in paddle 106 is put into a standby state above a sheet to be discharged so as not to interfere the sheet by driving a paddle lifting motor M252 based on detection information of a paddle HP sensor S243 shown in FIG. 6 and described later.

Still further, when the sheet is discharged to the intermediate processing tray 107, the draw-in paddle 106 is moved downward by the paddle lifting motor M252 reversely driven and is rotated counterclockwise by a paddle motor not shown at adequate timing. The sheet is drawn in and a rear end of the sheet is abutted against a rear end stopper 108. Here, in the present embodiment, an aligning portion 130 aligning the sheets tacked on the intermediate processing tray 107 is composed of the draw-in paddle 106, the rear end stopper 108, and the front and rear aligning plates 109*a* and 109*b*. It is noted that if an inclination of the intermediate processing tray 107 is large, the sheet can be abutted against the rear end stopper 108 without using the draw-in paddle 106 or a knurled belt 117 described later.

It is noted that the processing portion 139 also includes a rear end assist 112 as shown in FIGS. 2A and 2B. The rear end assist 112 is moved to a receiving position for receiving the sheet from a position where the rear end assist 112 does not interfere with movement of the binding device 100A specified later, by an assist motor M254 driven based on a detection signal of an assist HP sensor S244 shown in FIG. 6 and described later. Then, the rear end assist 112 discharges a sheet bundle to the stacking tray 114 after a binding process performed on the sheet bundle as described later.

The finisher 100 also includes an inlet roller pair 101 taking the sheet into the apparatus and a sheet discharging roller 103. The sheet P discharged out of the apparatus body 900A is passed to the inlet roller pair 101. It is noted that at this time, an inlet sensor S240 detects a sheet passing timing in the same time. Then, the sheet P passed to the inlet roller pair 101 is discharged sequentially to the intermediate processing tray 107 by the sheet discharging roller 103, i.e., a sheet discharging portion, and is then abutted against the rear end stopper 108 by a returning portion such as the draw-in paddle 106 and the knurled belt 117. Thus, the sheets are aligned in the sheet conveying direction and an aligned sheet bundle is formed.

The finisher 100 also includes a rear end drop 105 as shown in FIGS. 2A and 2B. The rear end drop 105 is pushed up by the sheet P passing through the sheet discharging roller 103 as shown in FIG. 2A. Then, when the sheet P has passed through the sheet discharging roller 103, the rear end drop 105 drops by its own weight as shown in FIG. 2B and presses down the rear end of the sheet P from above.

The finisher 100 also includes a destaticizing needle 104 and a bundle pressor 115. The bundle pressor 115 presses the sheet bundle stacked on the stacking tray 114 by being rotated by a bundle pressor motor M255 shown in FIG. 6 and described later. The finisher 100 further includes a tray lower limit sensor S242, a bundle pressor HP sensor S245, and a tray HP sensor S241. In a case when the sheet bundle shades the tray HP sensor S241, the stacking tray 114 is lowered by a tray lifting motor M251 shown in FIG. 6 until when the tray HP sensor S241 is cleared to define a sheet surface position.

Figure 3A:
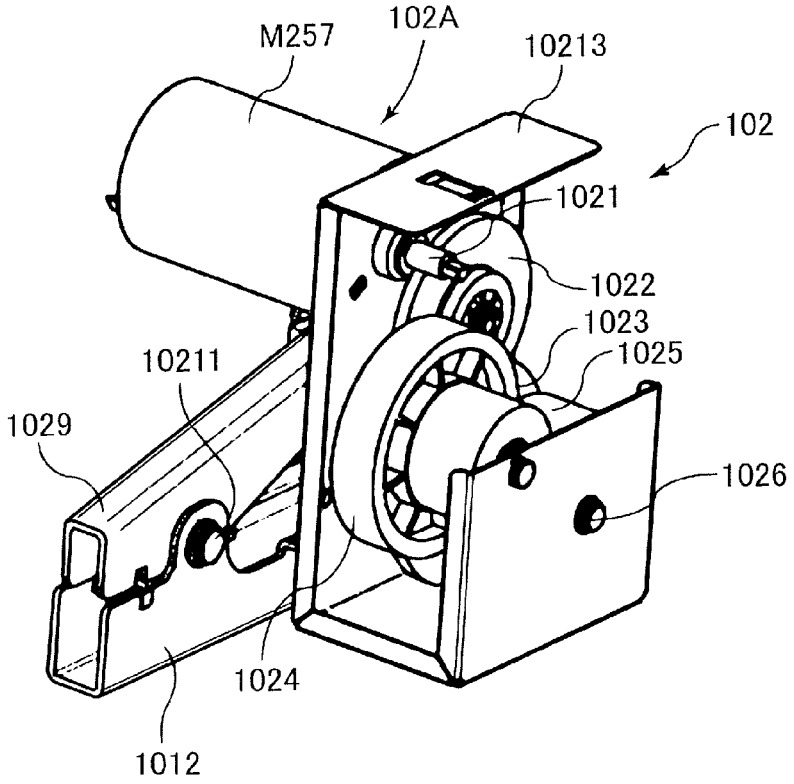
FIG. 3A is a perspective view of a back side of a stapleless binding unit provided in the finisher.

The binding device 100A also includes a stapleless binding unit 102, i.e., a stapleless binding portion. Here, as shown in FIG. 3A, the stapleless binding unit 102 includes a stapleless biding motor M257, a gear 1021 rotated by the stapleless binding motor M257, and step gears 1022 through 1024 rotated by the gear 1021. The stapleless binding unit 102 also includes a gear 1025 rotated by the step gears 1022 through 1024. The stapleless binding unit 102 further includes a lower arm 1012 fixed to a frame 10213 and an upper arm 1029 provided swingably centering on a swing shaft 10211 and biased toward the lower arm by a bias member not shown.

Figure 3B:
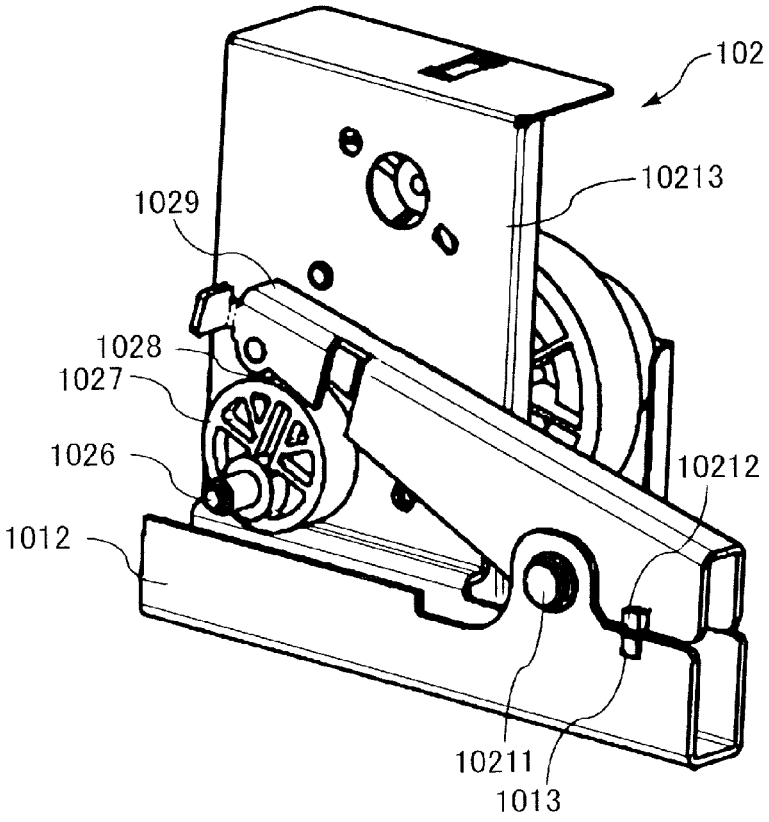
FIG. 3B a perspective view of a front side of the stapleless binding unit provided in the finisher.

Here, the gear 1025 is mounted to a rotating shaft 1026. As shown in FIG. 3B, a cam 1027 is mounted to the rotating shaft 1026. The cam 1027 is provided between the upper and lower arms 1029 and 1012. Thereby, when the stapleless binding motor M257 rotates, the rotation of the stapleless binding motor M257 is transmitted to the rotating shaft 1026 through the step gears 1022 through 1024 and the gear 1025, thus rotating the cam 1027.

It is noted that a moving portion 102A shown in FIGS. 3A and 3B swings the upper arm 1029. The moving portion 102A swings and moves the upper arm 1029 to a binding position where a plurality of sheets is bitten and bound by upper and lower teeth 10210 and 10214 described later. Still further, the moving portion 102A swings and moves the upper arm 1029 in an inverse direction to a release position (standby position) where the upper and lower teeth 10210 and 10214 are separated and the bite on the sheets is released. Thus, in the present embodiment, the moving portion 102A is composed of the stapleless binding motor M257, the cam 1027, the gear 1021, the step gears 1022 through 1024, and the gear 1025.

Figure 4A:
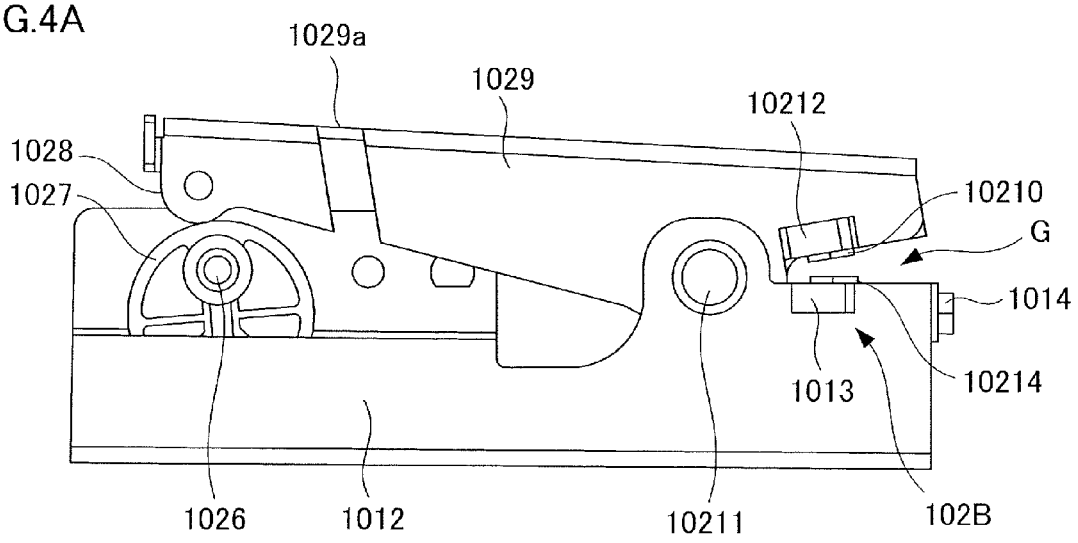
FIG. 4A is a side view of the stapleless binding unit in a disengaged state.
Figure 4B:
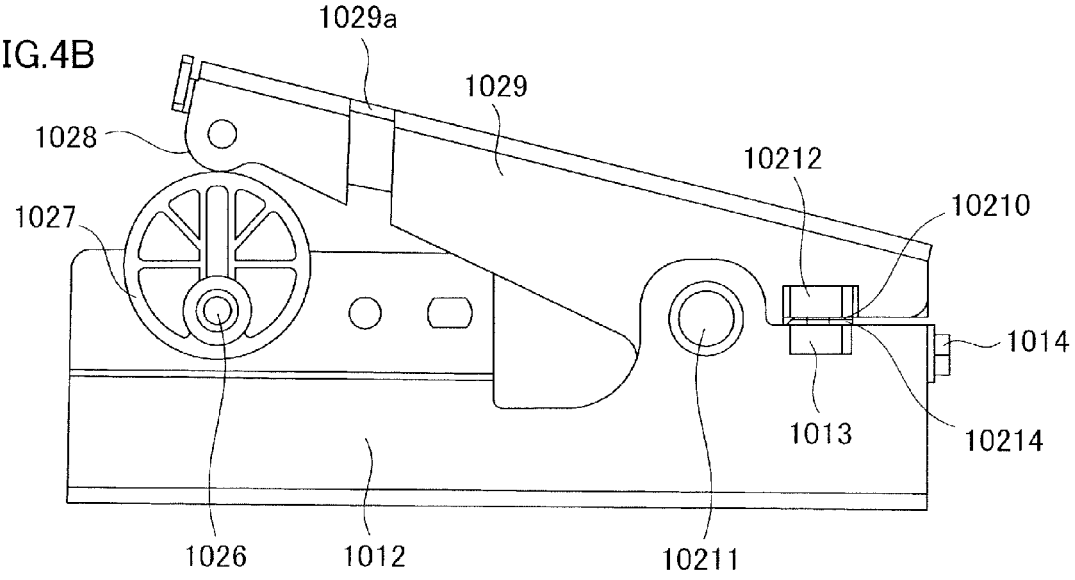
FIG. 4B is a side view of the stapleless binding unit in an engaged state.

Here, as shown in FIGS. 4A and 4B, a lower teeth block 1013 is mounted at an upper end of an end portion on an opposite side of the cam 1027 of the lower arm 1012, i.e., a first supporting portion, and the lower teeth 10214, i.e., a first tooth form, are attached to the lower teeth block 1013. Still further, an upper teeth block 10212 is mounted at a lower end of an end portion on an opposite side of the cam 1027 of the upper arm 1029, i.e., a second supporting portion, and the upper teeth 10210, i.e., a second tooth form, are attached to the upper teeth block 10212.

Figure 10A:
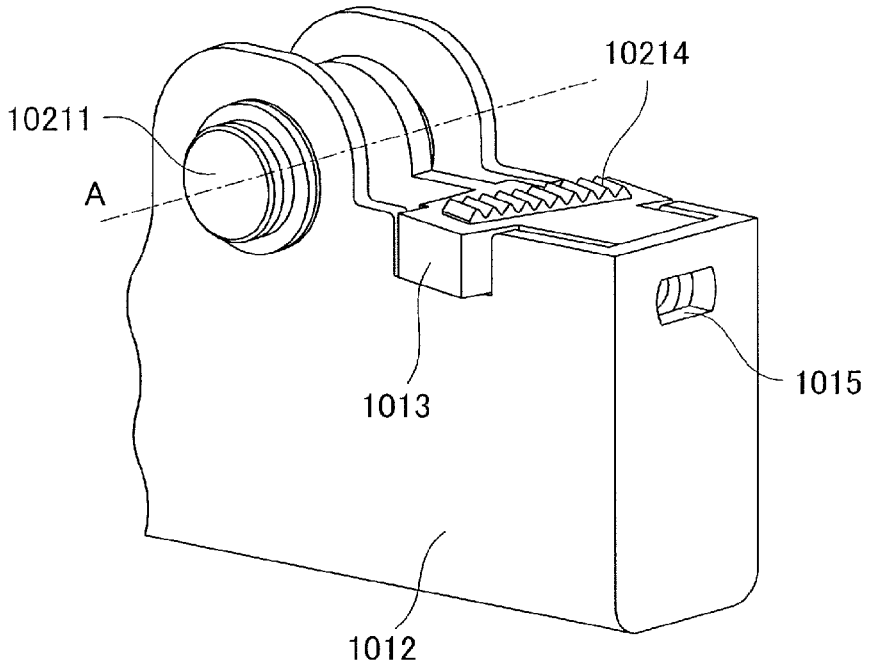
FIG. 10A is a partial perspective view of the stapleless binding unit illustrating the disposition of the lower teeth.
Figure 10B:
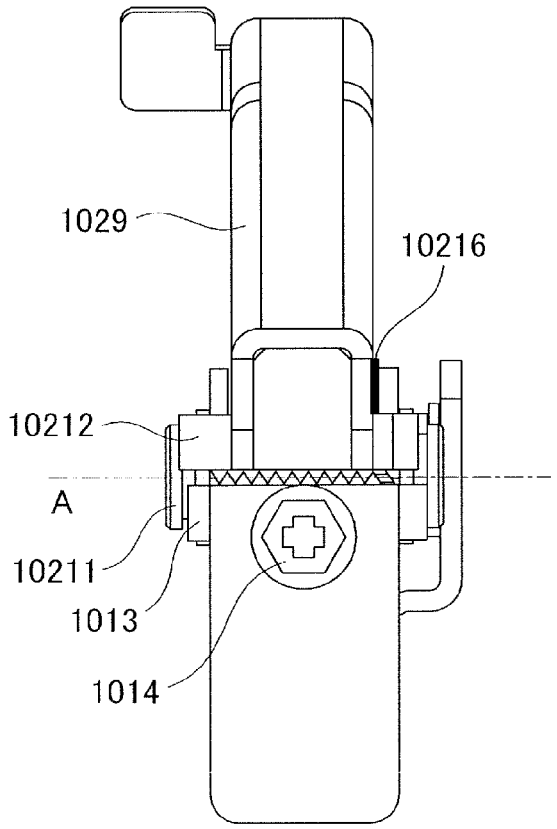
FIG. 10B is a front view of the stapleless binding unit.

That is, in the present embodiment, the upper arm 1029 is a second member in which the upper teeth block 10212, i.e., a second concavo-convex portion, is provided and pluralities of concavities and convexities of the second concavo-convex portion are composed of the upper teeth 10210 of the upper teeth block 10212. Still further, the lower arm 1012 is a first member in which the lower teeth block 1013, i.e., a first concavo-convex portion, is provided and pluralities of concavities and convexities of the first concavo-convex portion are composed of the lower teeth 10214 of the lower teeth block 1013. It is noted that in the present embodiment, while the upper arm 1029 is represented as the second member and the lower arm 1012 as the first member, the first member may be composed of the upper arm and the second member may be composed of the lower arm. Still further, as shown in FIGS. 4A and 4B, a binding portion 102B includes the pair of upper and lower teeth 10210 and 10214, i.e., the pair of teeth forms, and binds the plurality of sheets by clamping or biting by the upper and lower teeth 10210 and 10214. That is, in the present embodiment, the binding portion 102B is configured as a deforming portion for binding the sheet bundle by deforming the sheet bundle in a sheet thickness direction. The deforming portion includes the lower teeth block (the lower teeth 10214) 1013 provided in the lower arm (first member) 1012 and the upper teeth block (the upper teeth 10210) 10212 provided in the upper arm (second member) 1029. It is noted as shown in FIG. 10B described later, the lower teeth 10214 have a plurality of V-shaped teeth and the upper teeth 10210 have a plurality of ridge shaped teeth. Still further, the lower arm 1012 and the lower teeth block 1013 are designated as the first member and the first concavo-convex portion, and the upper arm 1029 and the upper teeth block 10212 are also designated as the second member and the second concavo-convex portion, respectively in the present embodiment. However, these components are configured such that they correspond with each other. Accordingly, these upper arm 1029 and upper teeth block 10212 may be designated as the first member and the first concavo-convex portion and the lower arm 1012 and the lower teeth block 1013 as the second member and the second concavo-convex portion.

Thereby, when the cam side end portion of the upper arm 1029 rises, the end portion on the side opposite from the cam 1027 of the upper arm 1029 lowers and clamps the sheet bundle together with the lower teeth 10214. Then, when the sheets of the sheet bundle are pressed by the clamp, fibers on the surface of the sheets of the sheet bundle are extended and exposed. Then, the sheet bundle is fastened as the fibers of the sheets entangle from each other as they are pressed further.

That is, the sheet bundle is fastened by swinging the upper arm 1029 and by biting and pressing the sheets by the upper teeth 10210 of the stapleless binding unit 1020 and the lower teeth 10214 of the lower arm 1012 in performing the binding process on the sheet bundle. Here, the position of the cam 1027 is detected by a cam sensor S247 shown in FIG. 6 and described later.

Figure 5:
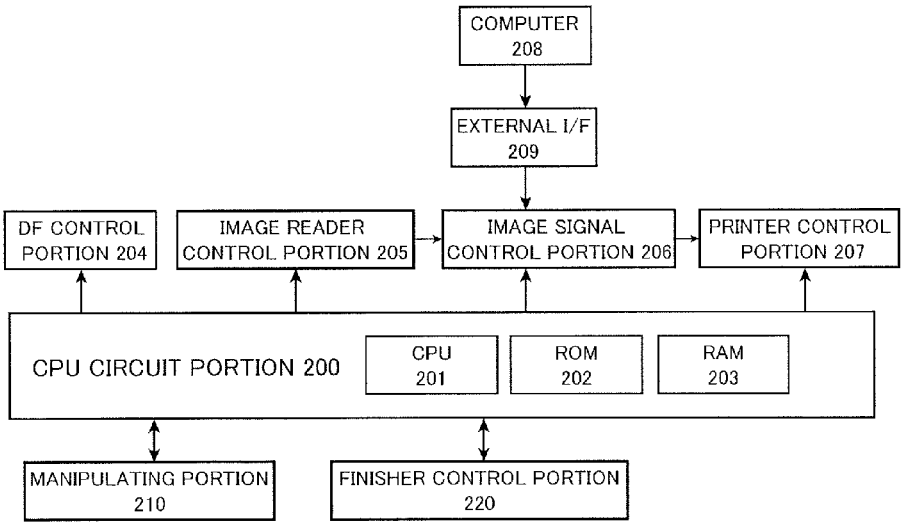
FIG. 5 is a control block diagram of the image forming apparatus.

FIG. 5 is a control block diagram of the image forming apparatus 900. As shown in FIGS. 5 and 1, the image forming apparatus 900 includes a CPU circuit portion 200 disposed at a predetermined position of the apparatus body 900A. The CPU circuit portion 200 includes a CPU 201, a ROM 202 storing control programs and others, and a RAM 203 used as an area for temporarily holding control data and as a work area of calculations accompanying the control.

Still further, FIG. 5 shows an external interface 209 between the image forming apparatus 900 and an external personal computer 208. Receiving print data from the external personal computer 208, the external interface 209 develops this data as bit map image and outputs it to an image signal control portion 206 as image data.

Then, the image signal control portion 206 outputs this data to a printer control portion 207, and the printer control portion 207 outputs the data from the image signal control portion 206 to an exposure control portion not shown. It is noted that an image of a document read by an image sensor not shown and provided in an image reading apparatus 950 is outputted from the image reader control portion 205 to the image signal control portion 206, and the image signal control portion 206 outputs this image output to the printer control portion 207.

Still further, a manipulating portion 210 includes a plurality of keys for setting various functions related to the image forming operation, a display portion, and others. Then, the manipulating portion 210 outputs a key signal corresponding to an operation of each key made by the user to a CPU circuit portion 200 and displays corresponding information based on a signal from the CPU circuit portion 200 on the display portion.

In accordance to control programs stored in the ROM 202 and to setting of the manipulating portion 210, the CPU circuit portion 200 controls the image signal control portion 206 and a document feeder 950A (see FIG. 1) through a DF (document feeder) control portion 204. The CPU circuit portion 200 also controls the image reading apparatus 950 (see FIG. 1) through the image reader control portion 205, the image forming portion 900B (see FIG. 1) through the printer control portion 207 and the finisher 100 through a finisher control portion 220, respectively.

It is noted that in the present embodiment, the finisher control portion 220 is mounted in the finisher 100 and the drive of the finisher 100 is controlled by exchanging information with the CPU circuit portion 200. It is also possible to dispose the finisher control portion 220 on the apparatus body side together with the CPU circuit portion 200 and to control the finisher 100 directly from the apparatus body side.

Figure 6:
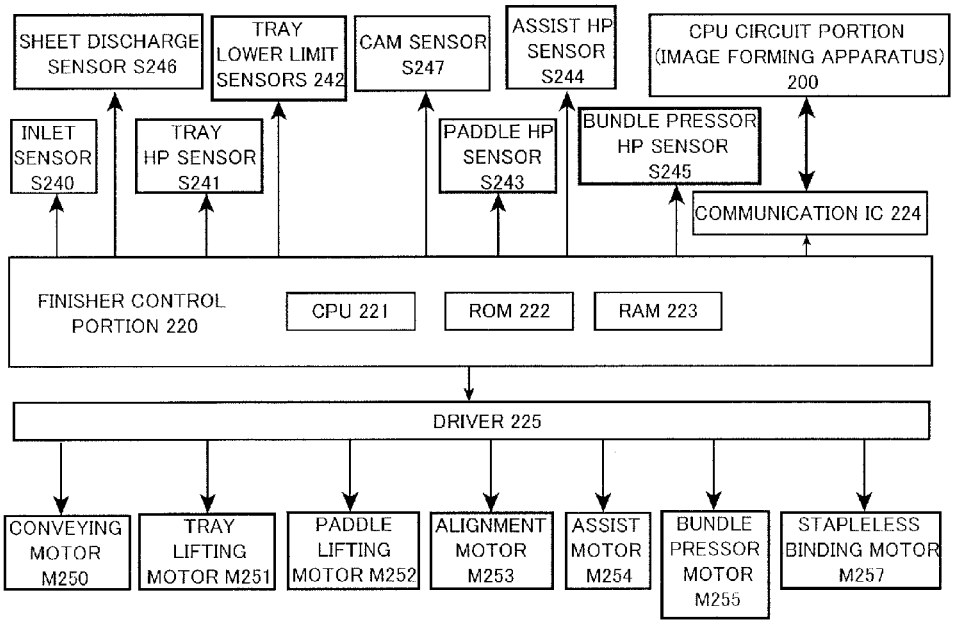
FIG. 6 is a control block diagram of the finisher.

FIG. 6 is a control block diagram of the finisher 100 of the present embodiment. The finisher control portion 220 is composed of a CPU (microcomputer) 221, a ROM 222, and a RAM 223. Then, the finisher control portion 220 exchanges data by communicating with the CPU circuit portion 200 through a communication IC 224 and controls the drive of the finisher 100 by executing various programs stored in the ROM 222 based on an instruction from the CPU circuit portion 200.

The finisher control portion 220 also drives, through a driver 225, a conveying motor M250, a tray lifting motor M251, a paddle lifting motor M252, an alignment motor M253, an assist motor M254, a bundle pressor motor M255, and a stapleless binding motor M257.

Connected also with the finisher control portion 220 are an inlet sensor S240, a sheet discharge sensor S246, a tray HP sensor S241, a tray lower limit sensor S242, a paddle HP sensor S243, an assist HP sensor S244, a bundle pressor HP sensor S245. A cam sensor S247 is also connected to the finisher control portion 220. Based on detection signals from these sensors, the finisher control portion 220 drives the alignment motor M253, the stapleless binding motor M257, and others.

By the way, the finisher control portion 220 controlling the operation of the stapleless binding unit 102 as described above detects a position of the cam 1027 at first by a sensor not shown in performing the stapleless binding operation on a sheet bundle. Then, the finisher control portion 220 controls the rotation of the stapleless binding motor M257 such that the cam 1027 is positioned at a bottom dead point as shown in and described with reference to FIG. 4A in receiving sheets before performing the stapleless binding operation.

It is noted that in the present embodiment, the swing shaft 10211 is the supporting portion. The supporting portion rotably supports at least one of the lower arm (first member) 1012 and the upper arm (second member) 1029 about a turning center. Still further, the upper arm 1029 provided swingably centering on the swing shaft 10211 is biased in a direction in pressure contact with the cam 1027 by a bias portion not shown. Then, when the cam 1027 is positioned at the bottom dead point, a gap G is created between the upper and lower teeth 10210 and 10214 and the sheet bundle is entered into the gap G in performing the stapleless binding operation.

Still further, the finisher control portion 220 rotates the stapleless binding motor M257 to swing the upper arm 1029 clockwise centering on the swing shaft 10211 by the cam 1027 in performing the stapleless binding operation. Then, as shown in FIG. 4B and described above, when the sheet bundle is clamped and fastened by the upper teeth 10210 of the upper arm 1029 and the lower teeth 10214 of the lower arm 1012 when the cam 1027 is positioned at a top dead point.

It is noted that if the cam 1027 is rotated further after positioning at the top dead point, a roller 1028 can ride over the top dead point of the cam 1027 because a deflecting portion 1029*a* provided on the upper arm 1029 deflects. Then, when the roller 1028 thus rides over the top dead point of the cam 1027, the upper arm 1029 moves in a direction in which the upper teeth 10210 separates from the lower teeth 10214. After that, when the cam 1027 rotates further and arrives again at the bottom dead point, a sensor not shown detects the cam 1027 and thereby the finisher control portion 220 stops the rotation of the stapleless binding motor M257.

Next, the stapleless binding operation of the finisher 100 of the present embodiment will be described. The sheet P discharged out of the image forming apparatus 900 is passed to the inlet roller pair 101 driven by the conveying motor M250 as shown in and described with reference to FIG. 2A. At this time, a front end of the sheet P is detected by the inlet sensor S240 simultaneously with the sheet passing timing.

Next, the sheet P passed to the inlet roller pair 101 is passed from the inlet roller pair 101 to the sheet discharging roller 103 and is conveyed and discharged to the intermediate processing tray 107 in the state in which a front end part thereof lifts the rear end drop 105 and the sheet P is destaticized by the destaticizing needle 104. A time during which a rear end part of the sheet P discharged to the intermediate processing tray 107 by the sheet discharging roller 103 drops to the intermediate processing tray 107 is shortened because the rear end is pressed from above by its own weight of the rear end drop 105.

Next, based on a signal of the rear end of the sheet P detected by the sheet discharge sensor S246, the finisher control portion 220 controls the operations on the sheets in the intermediate processing tray 107 carried out by the respective components. That is, as shown in and described above with reference to FIG. 2B, the finisher control portion 220 drops the draw-in paddle 106 to the intermediate processing tray 107 side by the paddle lifting motor M252 to bring into contact with the sheet P. At this time, because the draw-in paddle 106 is rotated counterclockwise by the conveying motor M250, the sheet P is conveyed to the rear end stopper 108 side in a right direction of FIG. 2B by the draw-in paddle 106 and the rear end of the sheet P is passed to the knurled belt 117. It is noted that when the rear end of the sheet P is passed to the knurled belt 117, the paddle lifting motor M252 drives the draw-in paddle 106 in a lift-up direction. Then, when the paddle HP sensor S243 detects that the draw-in paddle 106 has reached the HP (home position) thereof, the finisher control portion 220 stops to drive the paddle lifting motor M252.

Figure 7A:
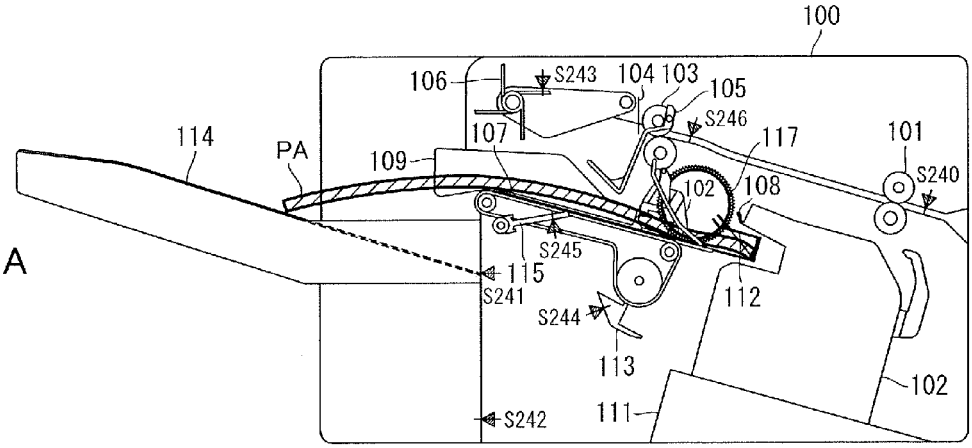
FIG. 7A is a side view illustrating the finisher in a state in which a sheet bundle is aligned on the intermediate processing tray.

The knurled belt 117 conveys, while slipping, the sheet P which has been conveyed to the rear end stopper 108 by the draw-in paddle 106, so that the sheet P is always biased to the rear end stopper 108. It is possible to correct a skew of the sheet P by abutting the sheet P against the rear end stopper 108 by this slipping conveyance. Next, after abutting the sheet P against the rear end stopper 108, the finisher control portion 220 drives the alignment motor M253 to move the aligning plate 109 in the width direction orthogonal to the sheet discharging direction to align the widthwise position of the sheet P. A sheet bundle PA aligned on the intermediate processing tray 107 is formed as shown in FIG. 7A by repeating this series of operations to a predetermined number of sheets to be bound.

Figure 7B:
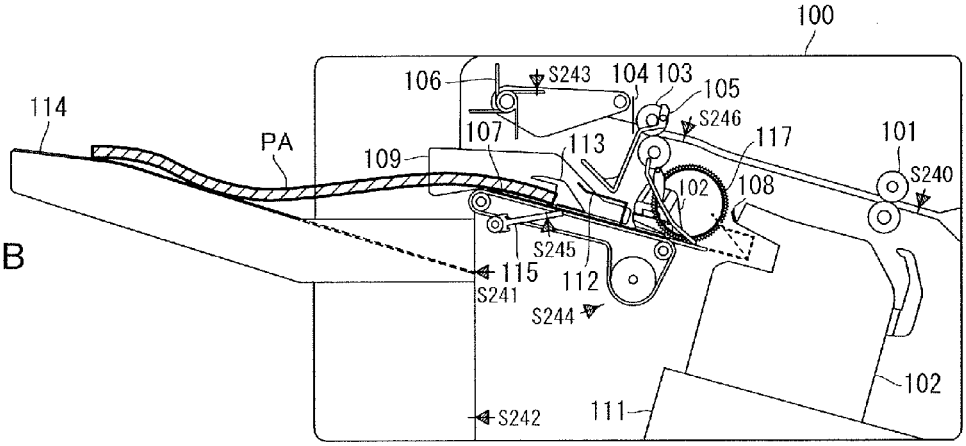
FIG. 7B is a side view illustrating the finisher in a state in which the sheet bundle on the intermediate processing tray is discharged to a stacking tray.

Next, if a binding mode is selected after performing such aligning operation, the stapleless binding operation is performed by the binding device. After that, a rear end of the sheet bundle PA is pushed by the rear end assist 112 and a discharge claw 113, i.e., a sheet discharging portion, driven by the assist motor M254 as shown in FIG. 7B and the sheet bundle PA on the intermediate processing tray 107 is discharged onto the stacking tray 114 in bundles.

Figure 7C:
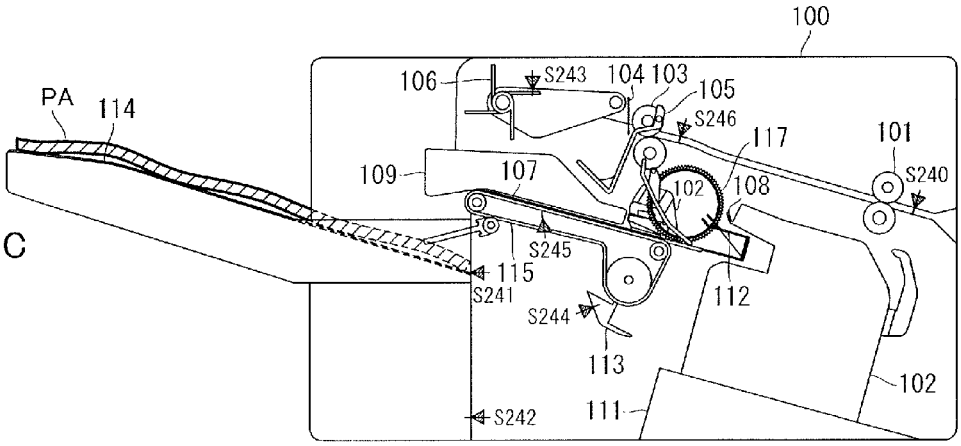
FIG. 7C is a side view illustrating the finisher in a state in which the sheet bundle is being discharged onto the stacking tray.

It is noted that after that, the bundle pressor 115 is rotated counterclockwise to press the rear end part of the sheet bundle PA to prevent the sheet bundle PA stacked on the stacking tray 114 pushed out in the conveying direction by a sheet bundle successively discharged as shown in FIG. 7C. Then, if the sheet bundle PA shades the tray HP sensor S241 after completing the bundle pressing operation by the bundle pressor 115, the finisher control portion 220 lowers the stacking tray 114 by the tray lifting motor M251 until when the tray HP sensor S241 is cleared to define the sheet surface position. It is possible to discharge a required number of sheet bundles PA on the stacking tray 114 by repeating the series of operations described above.

It is noted that in a case when the stacking tray 114 is lowered and the tray lower limit sensor S242 is still shaded, it is notified that the sheet bundles have been fully loaded onto the stacking tray 114 from the finisher control portion 220 to the CPU circuit portion 200 of the image forming apparatus 900 to suspend the image forming operation. When the sheet bundles on the stacking tray 114 are taken away after that, the stacking tray 114 is raised until when it shades the tray HP sensor S241. Then, the sheet surface of the stacking tray 114 is defined again by lowering the stacking tray 114 and clearing the tray HP sensor S241. Thereby, the image forming operation of the image forming apparatus 900 is resumed.

Figure 8:
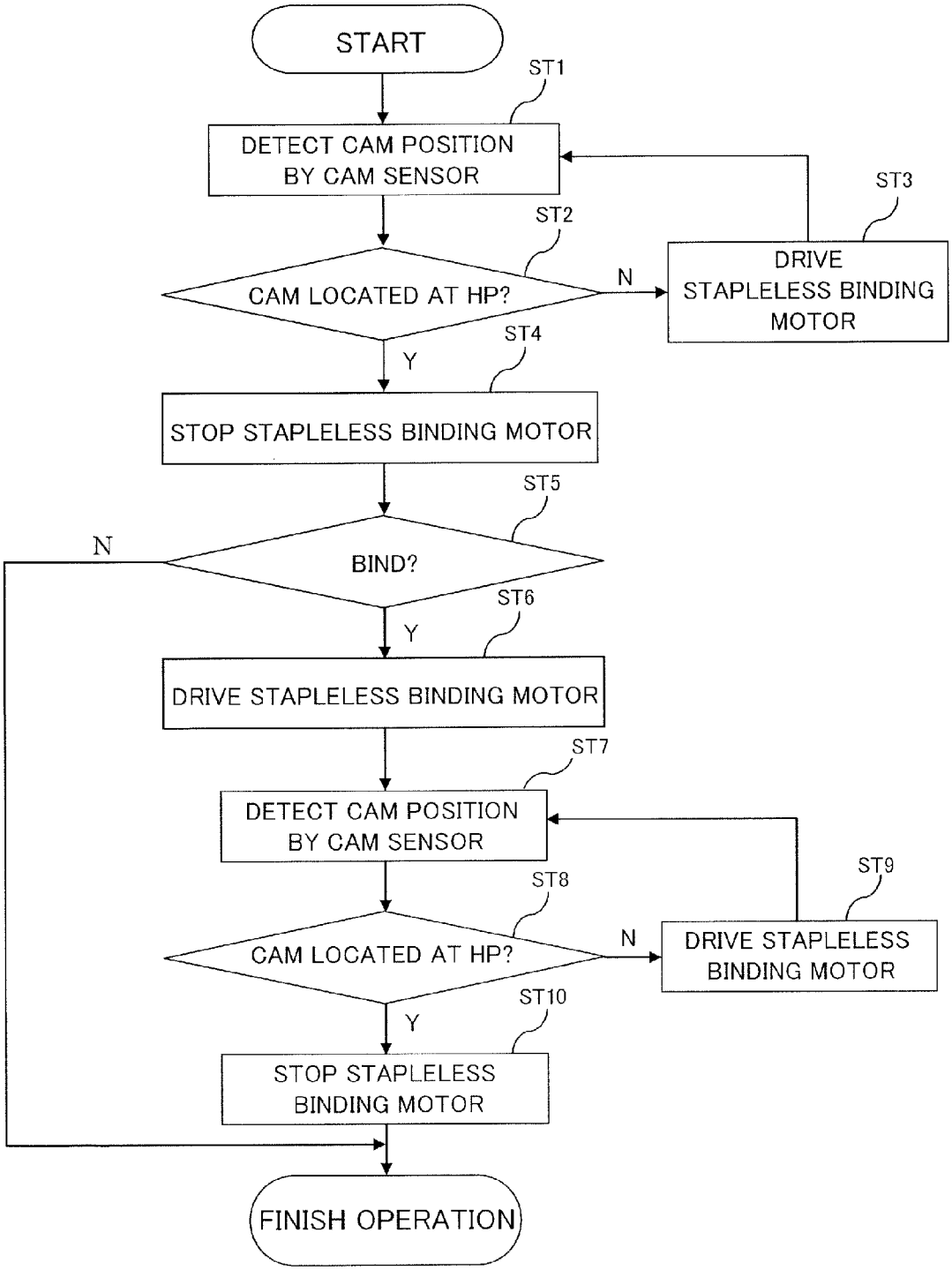
FIG. 8 is a flowchart illustrating a control of a stapleless binding operation of a finisher control portion of the finisher.

Next, the control on the stapleless binding operation of the finisher control portion 220 made in performing the stapleless binding operation will be described with reference to a flowchart shown in FIG. 8. When the stapleless binding operation is to be performed on the sheets, firstly the finisher control portion 220 drives the stapleless binding motor M257 such that the cam 1027 moves to a HP (home position), i.e., the bottom deal position.

Then, the finisher control portion 220 detects a position of the cam 1027 by the cam sensor S247 shown in FIG. 6 in Step 1, and when it is determined that the cam 1027 is not positioned at the home position, i.e., No in Step 2, the finisher control portion 220 continuously drives the stapleless binding motor M257 in Step 3. Then, when the finisher control portion 220 detects that the cam 1027 is positioned at the home position by the cam sensor S247, i.e., Yes in Step 2, the finisher control portion 220 stops the stapleless binding motor M257 in Step 4. Thereby, a sheet receiving condition to be made before the stapleless binding operation is completed.

Next, the finisher control portion 220 judges whether or not the binding operation should be performed in Step 5. When the stapleless binding operation is to be performed, i.e., Yes in Step 5, the finisher control portion 220 drives the stapleless binding motor M257 in Step 6 and swings the upper arm 1029 clockwise centering on the swing shaft 10211 by the cam 1027. When the cam 1027 is rotated further and arrives at the position shown in FIG. 4B, the sheet bundle is clamped and fastened by the upper teeth 10210 of the upper arm 1029 and the lower teeth 10214 of the lower arm 1012. When the cam 1027 rotates further after that, the upper arm 1029 swings counterclockwise centering on the swing shaft 10211 and the upper teeth 10210 moves in the direction separating from the lower teeth 10214.

Next, the finisher control portion 220 detects the position of the cam 1027 by the cam sensor S247 in Step 7, and when it is judged that the cam 1027 is not positioned at the home position, i.e., No in Step 8, the finisher control portion 220 continuously drives the stapleless binding motor M257 in Step 9. When the finisher control portion 220 detects that the cam 1027 is positioned at the home position by the cam sensor S247 after that, i.e., Yes in Step 8, the finisher control portion 220 stops the stapleless binding motor M257 in Step 10. Thus, the sheet bundle binding operation is completed. In a case when no binding operation is performed, i.e., No in Step 5, the sheet bundle binding operation is finished at that time without binding the sheet bundle.

Figure 9A:
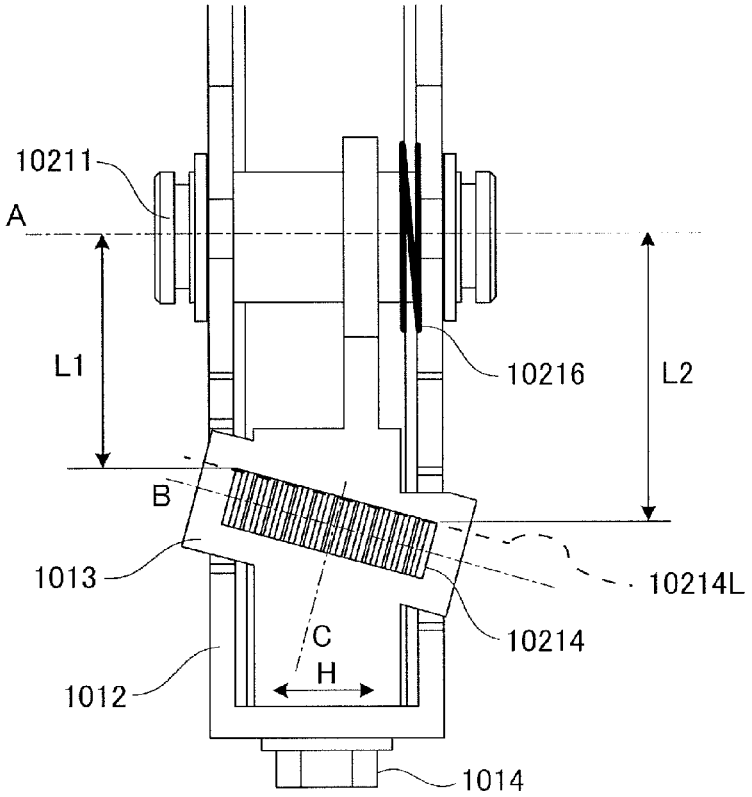
FIG. 9A is a plan view illustrating lower teeth provided in the binding portion of the stapleless binding unit.

By the way, the upper arm 1029 provided swingably centering on the swing shaft 10211 is biased in an axial direction of the swing shaft 10211 by a spring washer 10216, i.e., an elastic member, interposed between the upper and lower arms 1029 and 1012 as shown in FIG. 9A. Still further, according to the present embodiment, a straight line B of the lower teeth 10214 in parallel with a teeth arrangement direction is inclined with respect to a center line A of the swing shaft 10211 with a predetermined angle as shown in FIG. 9A.

That is, the lower teeth 10214 is mounted to the lower arm 1012 while inclining by a predetermined angle with respect to the swing shaft 10211. It is noted that this predetermined angle is an angle by which the center line A, i.e., the axial line of the swing shaft 10211, is not paralleled with the straight line B and which includes an angle that makes the center line A orthogonal to the straight line B. Thereby, a distance L1, in a perpendicular direction orthogonal to the center line A of the swing shaft 10211, between one end in the teeth arrangement direction of the lower teeth 10214 and the center line A of the swing shaft 10211 becomes different from a distance L2 between another end in the teeth arrangement direction of the lower teeth 10214 and the center line A of the swing shaft 10211. That is, the lower teeth block (the first concavo-convex portion) 1013 is configured such that the distance L1 between one end on a side of the turning center A of one convex portion among the lower teeth (pluralities of concavities and convexities) 10214 and the turning center A is different from the distance L2 between another end on the side of the turning center of another convex portion and the turning center A. In other words, the lower teeth block (deforming portion) 1013 is configured such that the distances from the lower teeth block 1013 to the turning center A in the direction perpendicular to the axial line of the turning center A are different in the direction in parallel with the axial line of the turning center A.

That is, the lower teeth 10214 of the lower teeth block 1013 is disposed such that one convex portion among the lower teeth 10214 starts to deform the sheet bundle at a timing different from that of another convex portion among the lower teeth 10214 in clamping the sheet bundle by the lower and upper teeth blocks 1013 and 10212. More specifically, the lower teeth block 1013 is arranged such that the edges (line 10214L passing along the edge on the turning center A side in FIGS. 9A and 14B) on the turning center A side of the lower teeth 10214 are aligned to incline with respect to the axial direction of the turning center A. Still further, each of the lower and upper teeth blocks (first and second concavo-convex portions) 1013 and 10212 extends in a direction inclined with respect to the axial line of the turning center A.

Figure 9B:
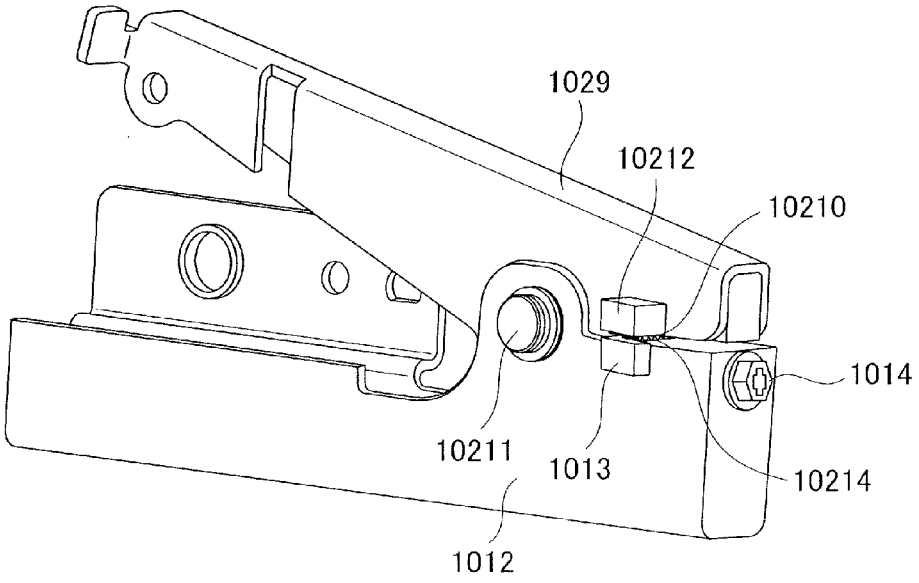
FIG. 9B is a perspective view illustrating disposition of the lower and upper teeth provided in a binding portion of the stapleless binding unit.

It is noted that in the present embodiment, a straight line C, in a direction orthogonal to the teeth arrangement direction of the lower teeth 10214, indicating an orientation of the teeth of the lower teeth 10214 is also orthogonal to the straight line B. The upper teeth 10210 are also disposed with an angle similar and corresponding to the lower teeth 10214. Thereby, the upper and lower teeth 10210 and 10214 can engage with each other as shown in FIG. 9B. It is noted that in the present embodiment, one end of the sheet bundle on which the binding process is to be performed is set between the gap G between the upper and lower teeth 10210 and 10214 in binding the sheet bundle as shown in FIGS. 4A and 4B described above in a state in which the one end of the sheet bundle is in parallel with the center line A of the swing shaft 10211.

Still further, according to the present embodiment, the engagement of the upper and lower teeth 10210 and 10214 is adjusted in an assembling stage. Here, the upper teeth 10210 is fixed to the upper teeth block 10212 by means of a setscrew 10217 shown in FIG. 11 and described later. It is noted that because the upper arm 1029 is in pressure contact with the lower arm 1012 by being biased by the spring washer 10216, the upper arm 1029 does not wobble in the direction of the center line A of the swing shaft 10211 as described above.

Then, in the present embodiment, the position of the lower teeth 10214 is adjusted based on the upper teeth 10210 fixed in advance in such condition. Here, as shown in FIG. 10A, the lower teeth 10214 are fixed to the lower teeth block 1013, and the lower teeth block 1013 is made movable within a gap between the lower teeth block 1013 and the lower arm 1012 in a direction in parallel with the center line A of the swing shaft 10211 as indicated by an arrow H in FIG. 9A described above. It becomes possible to move the lower teeth 10214 to a position engaging with the upper teeth 10210 through the lower teeth block 1013 by thus making the lower teeth block 1013 movable. Still further, the lower arm 1012 is provided with a mounting hole 1015 as shown in FIG. 10A and a screw 1014 is mounted to the mounting hole 1015 as shown in FIG. 10B.

Then, when the position of the lower teeth 10214 is to be adjusted, the cam 1027 is rotated manually for example to swing the upper arm 1029 to lower the upper teeth 10210. If the upper and lower teeth 10210 and 10214 engage without abutting against each other at this time, the lower teeth 10214 is fixed by the screw 1014 in this state. Still further, if the upper teeth 10210 abut against the lower teeth 10214, the lower teeth block 1013 is moved in parallel with the center line A of the swing shaft 10211 until when the upper teeth 10210 engage with the lower teeth 10214 as shown in FIG. 10B.

After that, it is possible to fix the lower teeth 10214 at the position engaging with the upper teeth 10210 by fixing the lower teeth block 1013, which has moved to the position where the lower teeth 10214 engage with the upper teeth 10210, by the screw 1014. This arrangement makes it possible to meet engagement precision of the teeth forms without being swayed by machining precision of the upper teeth 10210, the upper teeth block 10212, the upper arm 1029, the swing shaft 10211, the lower arm 1012, the lower teeth block 1013 and the lower teeth 10214. As a result, the stapleless binding operation can be steadily performed.

Figure 11:
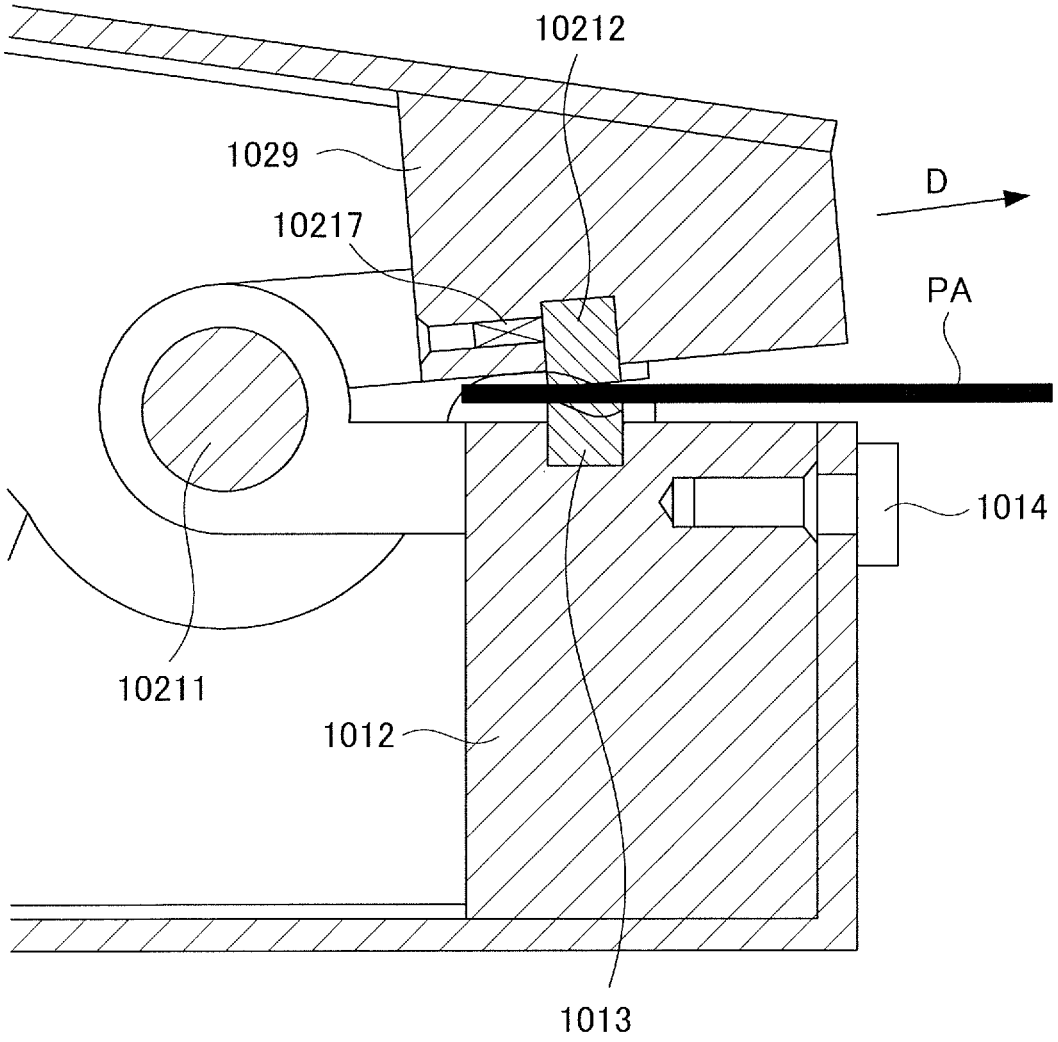
FIG. 11 is a schematic diagram illustrating a method how to fix the upper teeth.

It is noted that when the stapleless binding operation is performed on the sheet bundle after positioning the upper and lower teeth 10210 and 10214, the upper arm 1029 is opened slight by the thickness of the sheet bundle PA as shown in FIG. 11 in a case when a thickness of the sheet bundle is thick. Therefore, when the teeth side of the upper arm 1029 is fallen down, a force is applied to the upper teeth 10210 in a direction of an arrow D.

Here, the upper teeth block 10212 is pressed in the direction of the arrow D, i.e., a radial direction of the swing shaft 10211, with respect to the upper arm 1029 by the setscrew 10217. Thereby, the upper teeth 10210 are fixed to the upper arm 1029 through the upper teeth block 10212. That is, the upper teeth 10210 are fixed so as not to move in the direction of the arrow D by the setscrew 10217. This arrangement makes it possible to prevent the fixation of the upper teeth 10210 from been loosened even when the force is applied in the direction of the arrow D during the stapleless binding operation.

Figure 12A:
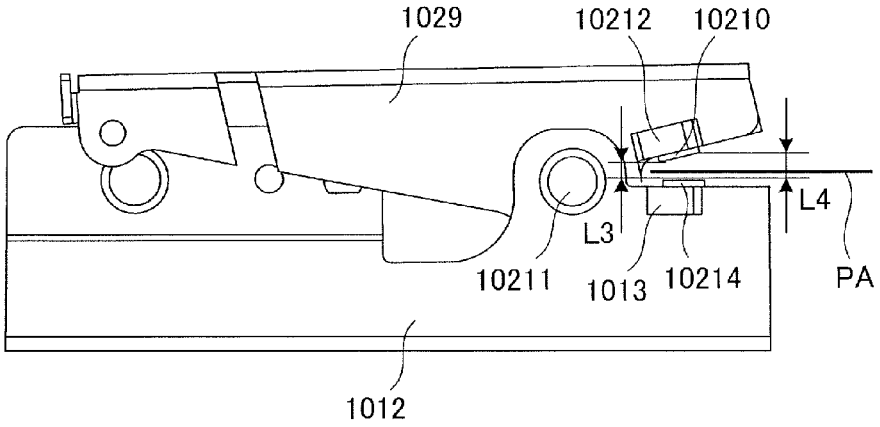
FIG. 12A is a side view showing a state in which the stapleless binding unit is opened.
Figure 12B:
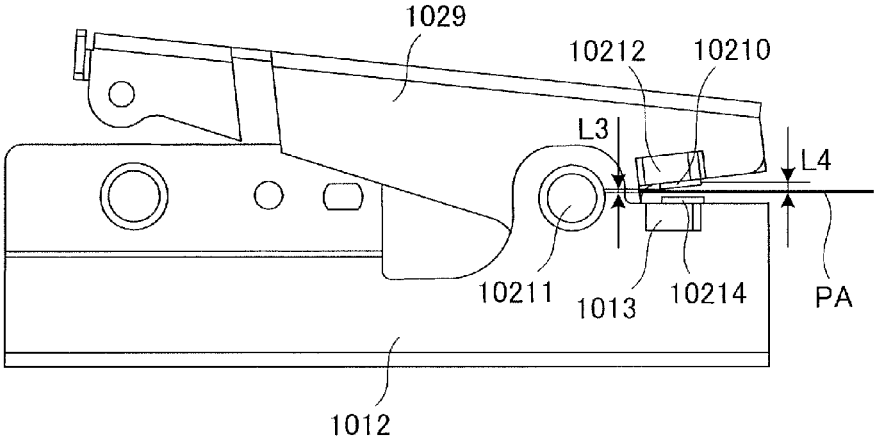
FIG. 12B is a side view illustrating a state in which the upper arm is being turned with respect to the lower arm.

Gaps L3 and L4 are made between the upper and lower teeth 10210 and 10214 as shown in FIG. 12A before the cam 1027 described above and shown in FIGS. 4A and 4B is rotated in performing the stapleless binding operation. These gaps L3 and L4 are L3<L4 because the upper and lower teeth 10210 and 10214 are disposed obliquely with respect to the swing shaft 10211. When the upper arm 1029 starts to lower as the cam 1027 rotates, the difference between the gaps L3 and L4 is gradually reduced. Along with that, the sheet bundle PA is pressed sequentially from an end part thereof on the L3 side where the gap is narrow as shown in FIG. 12B. Finally, the fall of the upper arm 1029 stops when the pressurization of the sheet bundle PA made by the upper and lower teeth 10210 and 10214 is finished as the difference between the gaps between the upper and lower teeth 10210 and 10214 is eliminated.

Figure 12C:
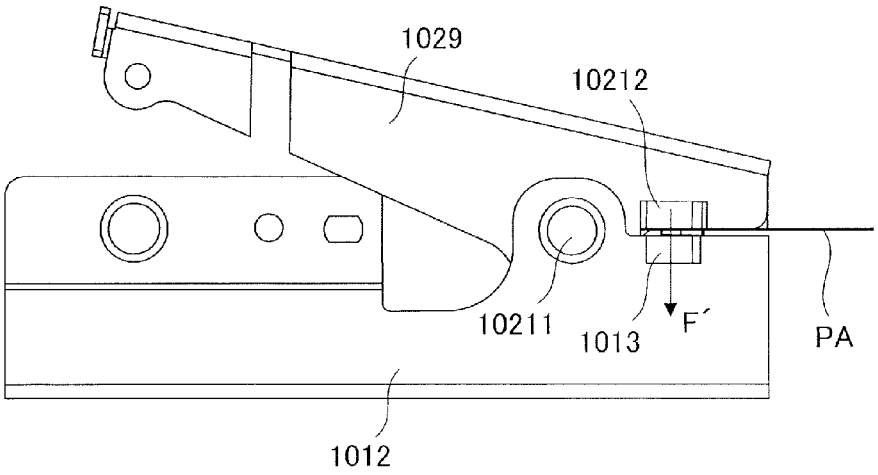
FIG. 12C is a side view illustrating a state in which the stapleless binding unit is closed and clamps the sheet bundle by the upper and lower teeth thereof.
Figure 13A:
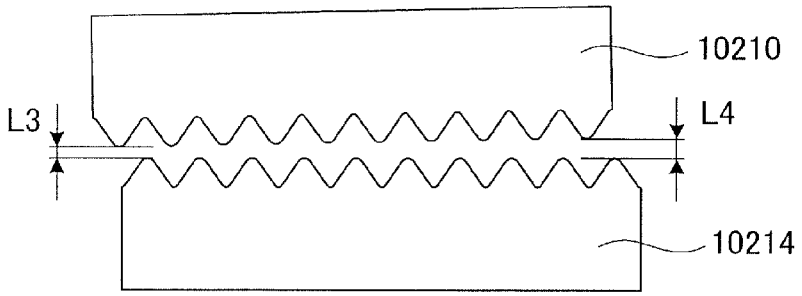
FIG. 13A is a schematic diagram illustrating distances between the upper and lower teeth.
Figure 13B:
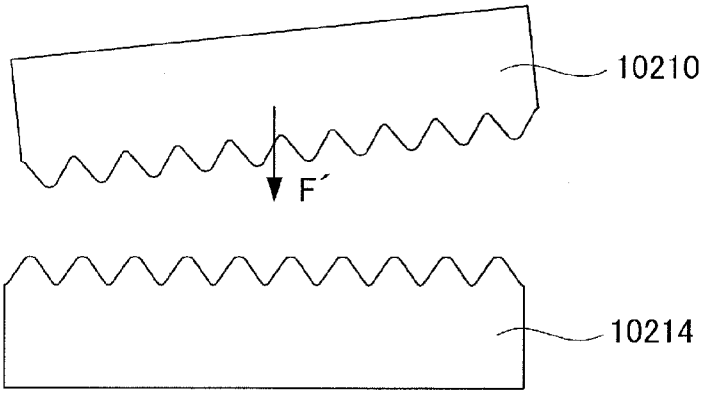
FIG. 13B is a schematic diagram illustrating a relationship between the upper and lower teeth in a state in which the stapleless binding unit is opened.
Figure 13C:
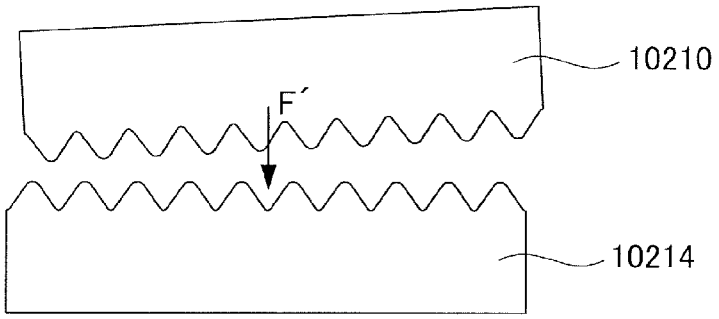
FIG. 13C is a schematic diagram illustrating the relationship between the upper and lower teeth in a state in which the stapleless binding unit is being closed.
Figure 13D:
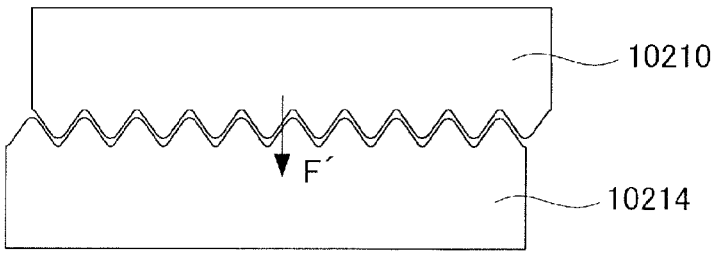
FIG. 13D is a schematic diagram illustrating the relationship between the upper and lower teeth in a state in which the stapleless binding unit has been closed.

Next, a turning orbit of the upper teeth 10210 will be described by using FIGS. 13A through 13D which show the upper and lower teeth 10210 and 10214 seen from the direction of the straight line C described above and shown in FIG. 9A. It is noted that only the upper and lower teeth 10210 and 10214 are shown for the sake of the description in FIGS. 13A through 13D. Here, when the upper teeth 10210 swings centering on the swing shaft 10211 and located at the opened position as shown in FIGS. 12A through 12C, the gaps L3 on the side close to the swing shaft 10211 is narrow and the gap L4 on the side far from the swing shaft 10211 is wide between the upper and lower teeth 10210 and 10214.

When the upper arm 1029 starts to fall from this state, the difference between the gaps L3 and L4 is gradually reduced as shown in FIG. 13A and FIGS. 13B through 13D. That is, in the state in which the lower arm (first member) 1012 and the upper arm (second member) 1029 are separated from each other, the side close to the turning center A of the swing shaft 10211 of the gap between the lower teeth block (first concavo-convex portion) 1013 and the upper teeth block (second concavo-convex portion) 10212 is narrower than that of the side far from the turning center A. Still further, the lower teeth block 1013 and the upper teeth block 10212 are disposed such that the gaps thereof are equalized in a state when the lower and upper arms 1012 and 1029 bind the sheet bundle. Then, as the gaps are thus gradually reduced, the sheet bundle is clamped sequentially from one end to the other end of the upper and lower teeth 10210 and 10214. That is, in the present embodiment, the sheet bundle PA is deformed gradually by the lower and upper teeth blocks 1013 and 10212 in the axial direction of the turning center from the side of L3 where the gap is narrow. While it is necessary to generate a clamping pressure greater than a predetermined pressure deforming the sheet bundle between the lower and upper teeth blocks 1013 and 10212, an engaging region, which starts to bind the sheet bundle, of the concavities and convexities of the lower and upper teeth blocks 1013 and 10212 moves in along the direction of the turning center A of the swing shaft 10211 corresponding to a turning amount of the upper arm 1029. Therefore, it is not necessary to generate the clamping pressure simultaneously at all of the engaging regions (parts) of the concavities and convexities of the lower and upper teeth blocks 1013 and 10212, so that a load associated with the deformation can be temporally dispersed and the driving force of the upper arm 1029 can be lessened as a result. This arrangement makes it possible to complete the stapleless binding operation of the sheet bundle with a load F' that is smaller than the load F required in deforming the sheet bundle PA simultaneously.

As described above, it is possible to clamp the sheet bundle sequentially from one end to the other end of the upper and lower teeth 10210 and 10214 by disposing the upper and lower teeth 10210 and 10214 while inclining with respect to the axial direction of the swing shaft 10211 as described in the present embodiment. This arrangement makes it possible to reduce a total load while applying a load F necessary for fastening the sheet bundle. As a result, a strong fastening force can be obtained without increasing the cost of the device.

Figure 14A:
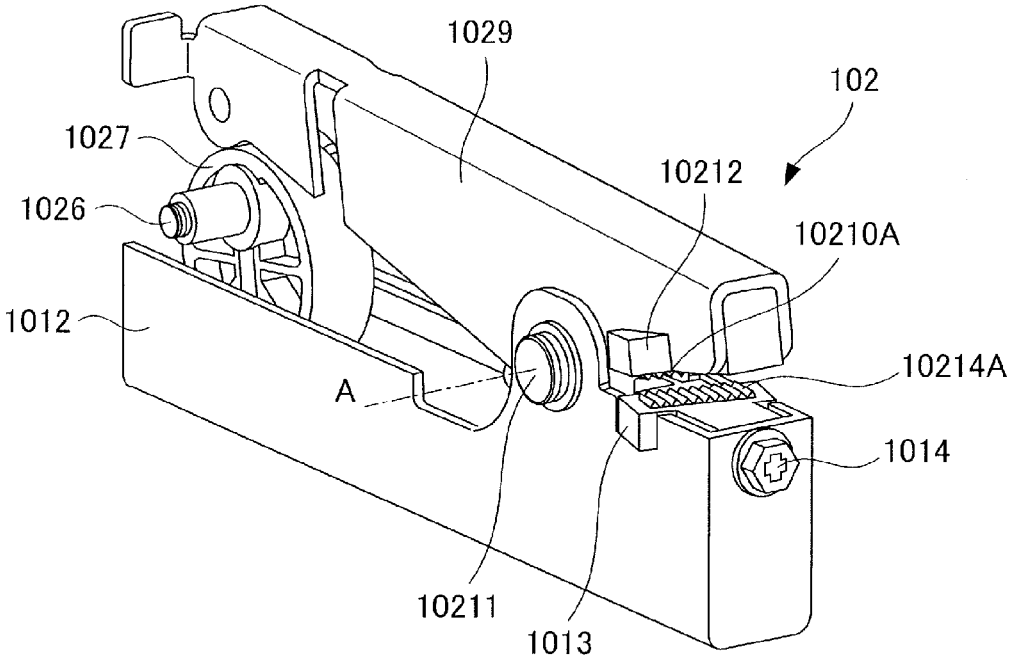
FIG. 14A is a perspective view illustrating another configuration of the lower and upper teeth.
Figure 14B:
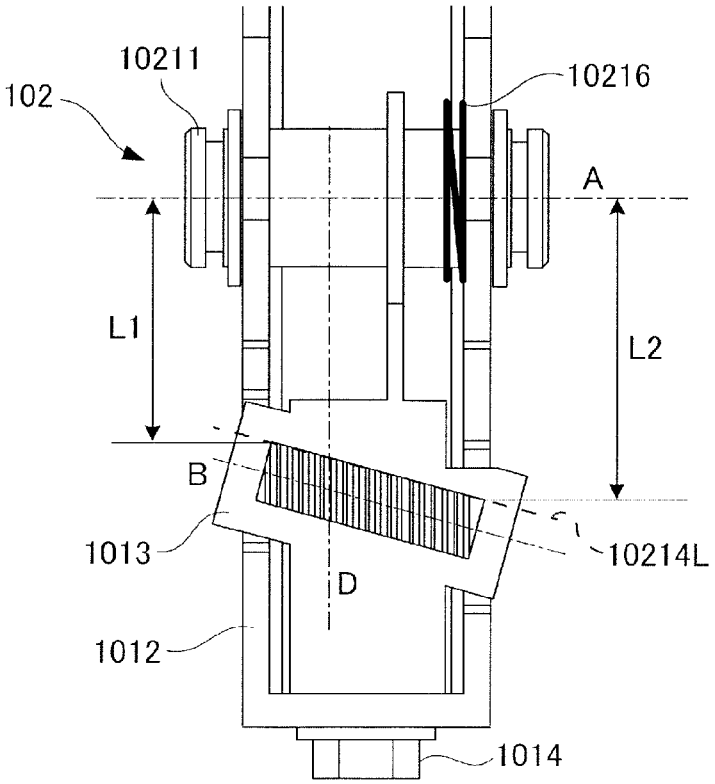
FIG. 14B is a plan view illustrating another configuration of the lower teeth.

It is noted that the upper and lower teeth 10210 and 10214 whose orientation is orthogonal to the teeth arrangement direction have been used in the above description. However, as the upper and lower teeth 10210 and 10214, ones whose orientation of teeth are rectangular to the center line A of the swing shaft 10211 and are configured such that whose ends on the side of the center line A of the swing shaft 10211 are aligned so as to incline in the teeth arrangement direction such as upper and lower teeth 10210A and 10214*a* as shown in FIGS. 14A and 14B may be used for example.

Even in a case in which such upper and lower teeth 10210A and 10214*a* are used, the distances of the ends thereof are L1<L2 because the center line A of the swing shaft 10211 and the straight line B of the tooth form are inclined from each other with a predetermined angle. Accordingly, the deformation of the sheet bundle PA is carried out gradually from the side L1 where the gap is narrow, so that the load associated with the deformation can be dispersed.

Still further, the case in which the position of the lower teeth 10214 is adjusted with respect to the upper teeth 10210 by fixing the lower teeth block 1013 by the screw 1014 has been described in the above explanation, the present invention is not limited to such configuration. Then, another fixing method will be described next with reference to FIGS. 15A and 15B. It is noted that in FIGS. 15A and 15B, the same reference numerals with those in FIGS. 9A and 9B described above denote the same or corresponding portions.

Figure 15A:
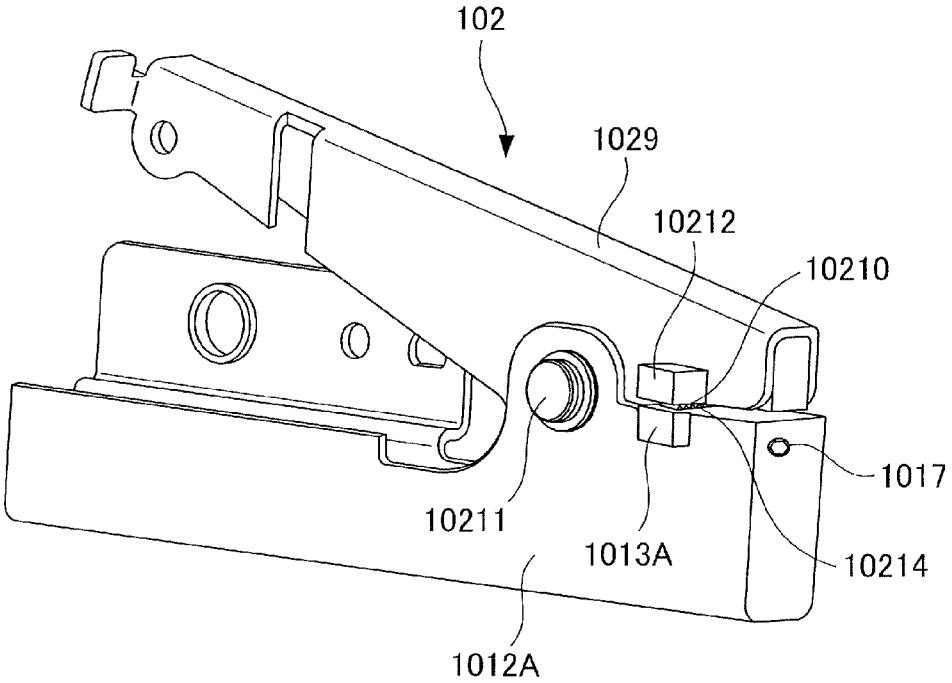
FIG. 15A is a perspective view illustrating another method how to fix the lower teeth.
Figure 15B:
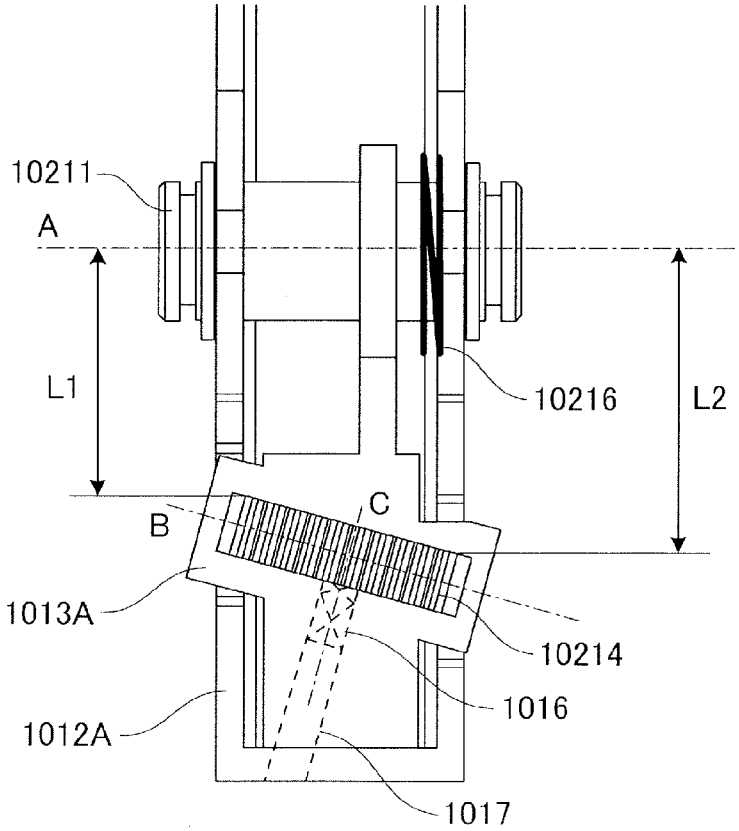
FIG. 15B is a plan view illustrating the other method how to fix the lower teeth.

In FIG. 15A, a lower teeth block 1013A is attached to a lower arm 1012A. Still further, as shown in FIG. 15B, a tapped hole 17 is made through the lower arm 1012A and the lower teeth block 1013A. Here, in the present embodiment, the lower teeth 10214 is mounted to the lower teeth block 1013A in a state movable in the direction of the straight line B of the tooth form of the lower teeth 10214, i.e., in the teeth arrangement direction. Then, the setscrew 1016 for fixing the lower teeth 10214 to the lower teeth block 1013A is screwed to the tapped hole 1017.

Then, the upper teeth 10210 are fallen in adjusting the position of the lower teeth 10214 as described above. When the upper teeth 10210 abut against the lower teeth 10214 at this time, the lower teeth 10214 are moved with respect to the lower teeth block 1013A in parallel with the center line A of the swing shaft 10211 until when the upper teeth 10210 engage with the lower teeth 10214. After that, the lower teeth 10214 moved to the position engaging with the upper teeth 10210 is fixed to the lower teeth block 1013A by the setscrew 1016 as shown in FIG. 15B.

Thus, in the present embodiment, the position of the lower teeth 10214 is adjusted by directly moving the lower teeth 10214 with respect to the upper teeth 10210, so that the alignment of the upper and lower teeth 10210 and 10214 can be made more accurately.

It is noted that the case of swinging the upper arm 1029 has been described in the above explanation, the present invention is not limited to such configuration and it is possible to modify such that the lower arm 1012 or 1012A swings. That is, it is possible to arrange such that at least one of the upper and lower arms 1029 and 1012 (1012A) swings.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-115529, filed Jun. 4, 2014, and Japanese Patent Application No. 2015-101950, filed May 19, 2015 which are hereby incorporated by reference herein in their entirety.

What is claimed is:

1. An image forming apparatus comprising:

an image forming unit; and a sheet binding unit configured to bind a sheet bundle including a sheet on which an image has been formed by the image forming unit, the sheet binding unit including:

a first member having a first surface in which pluralities of concavities and convexities are provided, a second member having a second surface in which pluralities of concavities and convexities are provided, wherein the second surface crimps the sheet bundle together with the first surface of the first member so as to bind the sheet bundle, and a supporting portion supporting at least one of the first and second members turnably centering on a turning axis, wherein the first surface is configured such that a first distance between an end on the turning axis side of a first convex portion of the pluralities of concavities and convexities and the turning axis is longer than a second distance between an end on the turning axis side of a second convex portion of the pluralities of concavities and convexities and the turning axis, and wherein the second distance is longer than a third distance between an end of the turning axis side of a third convex portion of the pluralities of concavities and convexities on the first surface and the turning axis.

2. The image forming apparatus according to claim 1, wherein the first surface is configured such that ends on the turning axis side of the pluralities of concavities and convexities are arrayed while inclining with respect to an axial line of the turning axis.

3. The image forming apparatus according to claim 1, wherein the pluralities of concavities and convexities on the first surface and the pluralities of concavities and convexities on the second surface extend in a direction inclined with respect to an axial line of the turning axis.

4. The image forming apparatus according to claim 1, wherein the first and second members are disposed such that a distance between the first and second surfaces is narrower on one side thereof close to the turning axis than the other side thereof far from the turning axis in a state in which the first and second members are separated from each other, and the distance between the first and second surfaces is equalized in a state in which the first and second members bind a sheet bundle.

5. The image forming apparatus according to claim 1, wherein an imaginary line passing the end on the turning axis side of the first convex portion, the end on the turning axis side of the second convex portion, and the end on the turning axis side of the third convex portion inclines with respect to an axial line of the turning axis.

6. The image forming apparatus according to claim 1, the end on the turning axis side of the first convex portion, the end on the turning axis side of the second convex portion, and the end on the turning axis side of the third convex portion are arranged in this order in a direction along an axial line of the turning axis.

7. The image forming apparatus according to claim 1, wherein the second surface is configured such that a fourth distance between an end on the turning axis side of a fourth convex portion of the pluralities of concavities and convexities and the turning axis is longer than a fifth distance between an end on the turning axis side of a fifth convex portion of the pluralities of concavities and convexities and the turning axis, and wherein the fourth distance is longer than a sixth distance between an end on the turning axis side of a sixth convex portion of the pluralities of concavities and convexities and the turning axis.

8. An image forming apparatus comprising:

an image forming portion configured to form an image on a sheet; and a binding portion configured to bind a sheet bundle including a first sheet on which an image has been formed by the image forming portion and a second sheet on which an image has been formed by the image forming portion, the binding portion including:

a first member, a second member having a rectangular crimping portion having a short side and a long side longer than the short side, wherein the rectangular crimping portion crimps a first portion of the first sheet and a second portion of the second sheet together with the first member such that the first portion and the second portion are bound to each other, and a supporting portion supporting at least one of the first and second members turnably centering on a turning axis, wherein the rectangular crimping portion is arranged such that the long side of the rectangular crimping portion is inclined with respect to the turning axis.

9. The image forming apparatus according to claim 8, wherein a first concavo-convex portion having pluralities of concavities and convexities is provided on the first member, and a second concavo-convex portion having pluralities of concavities and convexities is provided on the rectangular crimping portion of the second member, wherein the concavities and convexities of the second concavo-convex portion clamp and bind the sheet bundle together with the concavities and convexities of the first concavo-convex portion, and wherein the pluralities of concavities and convexities of the first concavo-convex portion are disposed such that one convex portion of the first concavo-convex portion starts to deform the sheet bundle at a timing different from that of another convex portion of the first concavo-convex portion in clamping the sheet bundle by the first and second members.

10. The image forming apparatus according to claim 9, wherein the first concavo-convex portion is configured such that ends on the turning axis side of the pluralities of concavities and convexities are aligned to incline with respect to an axial line of the turning axis.

11. The image forming apparatus according to claim 9, wherein each of the first and second concavo-convex portions extends in a direction inclined with respect to an axial line of the turning axis.

12. The image forming apparatus according to claim 8, wherein the binding portion is configured such that distances between regions, along an axial line of the turning axis, of the binding portion and the turning axis are different in a direction perpendicular to the axial line of the turning axis.

13. The image forming apparatus according to claim 8, wherein the first and second members are disposed such that a distance between the first and second concavo-convex portions is narrower on one side thereof close to the turning axis than that of another side thereof far from the turning axis in a state in which the first and second members are separated from each other, and the distance between the first and second concavo-convex portions is equalized in a state in which the first and second members bind a sheet bundle.

14. An image forming apparatus comprising:

an image forming unit; and a sheet binding unit configured to bind a sheet bundle including a sheet on which an image has been formed by the image forming unit, the sheet binding unit including:

a first member having a first surface in which pluralities of concavities and convexities are provided, a second member having a second surface in which pluralities of concavities and convexities are provided, wherein the second surface crimps the sheet bundle together with the first surface of the first member so as to bind the sheet bundle, and a supporting portion supporting at least one of the first and second members turnably centering on a turning axis, wherein the first surface is configured such that each of first through third convex portions of the pluralities of concavities and convexities extends in a predetermined direction, and an imaginary line connecting respective middle points in the predetermined direction of the first through the third convex portions inclines with respect to an axial line of the turning axis.

15. The image forming apparatus according to claim 14, wherein the first surface is configured such that a first distance between an end on the turning axis side of a first convex portion of the pluralities of concavities and convexities and the turning axis is longer than a second distance between an end on the turning axis side of a second convex portion of the pluralities of concavities and convexities and the turning axis, and wherein the second distance is longer than a third distance between an end on the turning axis side of a third convex portion of the pluralities of concavities and convexities and the turning axis.

16. The image forming apparatus according to claim 15, the end on the turning axis side of the first convex portion, the end on the turning axis side of the second convex portion, and the end on the turning axis side of the third convex portion are arranged, in a direction along an axial line of the turning axis, in order of the end on the turning axis side of the first convex portion, the end on the turning axis side of the second convex portion, and the end on the turning axis side of the third convex portion.

* * * * *